US006822397B2

(12) United States Patent
Kawasaki et al.

(10) Patent No.: US 6,822,397 B2
(45) Date of Patent: Nov. 23, 2004

(54) METHOD OF MANUFACTURING IMAGE FORMING APPARATUS

(75) Inventors: Hideshi Kawasaki, Tokyo (JP); Shuji Aoki, Kanagawa (JP); Izumi Tabata, Kanagawa (JP); Akihiko Yamano, Kanagawa (JP); Hisashi Sakata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/429,683

(22) Filed: May 6, 2003

(65) Prior Publication Data

US 2004/0034487 A1 Feb. 19, 2004

(30) Foreign Application Priority Data

May 8, 2002 (JP) ..... 2002-132588
Apr. 28, 2003 (JP) ..... 2003-124208

(51) Int. Cl.[7] ..... G09G 3/10

(52) U.S. Cl. ..... 315/169.2; 315/169.1; 445/3; 345/48; 345/56; 345/75.2

(58) Field of Search ..... 315/169.1–169.3; 445/3, 24, 51; 345/55, 75.2, 48, 56

(56) References Cited

U.S. PATENT DOCUMENTS 6,149,480 A 11/2000 Iwasaki et al. ..... 445/6
6,339,414 B1 * 1/2002 Todokoro et al. ..... 345/75.1
6,346,773 B1 * 2/2002 Takegami ..... 315/169.1
6,445,367 B1 * 9/2002 Suzuki et al. ..... 345/75.2
6,534,924 B1 * 3/2003 Oguchi et al. ..... 315/169.1
6,604,972 B1 8/2003 Yamano ..... 445/24
6,653,794 B2 * 11/2003 Sagano et al. ..... 315/169.2
6,743,066 B1 * 6/2004 Oguchi et al. ..... 445/6
2001/0036682 A1 11/2001 Takeda et al. ..... 438/34
2002/0122018 A1 9/2002 Kanda et al. ..... 438/34
2003/0036331 A1 2/2003 Aoki et al. ..... 445/6
2003/0057850 A1 3/2003 Aoki et al. ..... 315/169.1
2003/0083843 A1 5/2003 Yamano et al. ..... 702/127

FOREIGN PATENT DOCUMENTS

EP 0 803 892 A2 10/1997
JP 10-228867 8/1998
JP 2000-243256 9/2000

* cited by examiner

*Primary Examiner*—Haissa Philogene
(74) *Attorney, Agent, or Firm*—Fitzpatrick, Cella, Harper & Scinto

(57) ABSTRACT

The present invention relates to the adjustment of luminance. The present invention is a method of manufacturing image forming apparatus including a step of applying characteristic shift voltage comprising a plurality of pulses in which the amplitude of the pulse obtained from the look-up table has two or more values, to the emitter, the look-up table storing the amplitude of the pulse and the number of the pulse for shifting characteristic of emitters to a predetermined luminance target value on the basis of the measurement result of the luminance. Moreover, the present invention is a method of manufacturing image forming apparatus comprising a step of applying the second pulses of characteristic shift voltage having the amplitude which was determined in response to the measurement result of the luminance after the first characteristic shift voltage had been applied to the emitter.

6 Claims, 20 Drawing Sheets

METHOD OF MANUFACTURING IMAGE FORMING APPARATUS

This application claims the right of priority under 35 U.S.C. § 119 based on Japanese Patent Application Nos. JP 2002-1358, filed on May 8, 2002, and JP 2003-124208, filed on Apr. 28, 2003 which are hereby incorporated by reference herein in their entirety as if fully set forth herein.

BACKGROUND OF THE INVENTION

1. Field of the Invention

This invention relates to a method of manufacturing an image forming apparatus with a multiple electron source comprising a number of electron emitters.

2. Description of the Related Art

Conventionally, as a method of suppressing variation of electron emission characteristics of individual electron emitters constituting the multiple electron source, known is a method of adjusting a characteristic disclosed in JP-A-10-228867 (Literature 1) and JP-A-2000-243256 (Literature 2).

In the literature 1, disclosed is a fact that, in a multiple electron source in which Surface Conduction Electron Emitters (hereafter, represented by SCE-emitter) are arranged in a matrix, voltage to be measured of voltage value higher than display drive voltage is applied, and emission current or light emitting luminance is measured as electron emission characteristic of each SCE-emitter, and based upon the characteristic, standard value of the electron emission characteristic is obtained, and thereafter, characteristic shift voltage further higher voltage value than the voltage to be measured is determined so that the electron emission characteristic of each SCE-emitter becomes the value corresponding to the standard value, and by applying it to each SCE-emitter, the electron emission characteristics of respective SCE-emitters are aligned uniformly.

Further, in the literature 2, disclosed is a series of characteristic adjustment processes comprising a first period in which preliminary drive voltage of higher voltage value than the display drive voltage is applied to all SCE-emitters, a second period in which the electron emission characteristics of respective SCE-emitters are measured by applying the display drive voltage thereto, a third period in which the characteristic shift voltage of higher voltage value than the preliminary drive voltage is applied to each SCE-emitter, and a fourth period in which the electron emission characteristic is measured again by applying the display drive voltage after the characteristic shift voltage was applied.

However, in the characteristic adjustment process in which the characteristic is adjusted so as to become a value corresponding to the standard value of the conventional technology as described above, it was possible that variation of adjustment situations occurs with respect to each emitter.

Also, It is possible that, due to this occurrence of the variation of adjustment situations, the characteristic shift voltage was applied excessively so that the characteristic becomes of a value less than the standard value, and the characteristic was not shifted up to the standard value even after the characteristic shift voltage was applied only for a desired time period, which means that uniformity is not sufficiently improved.

Furthermore, there was a case that, when an identical amplitude is applied with respect to each emitter, shift amount is smaller than estimated amount in advance, and the time required until the characteristic is shifted to a target value is lengthened so that the process becomes a unrealistic lengthy process.

Accordingly, it is desired to establish a characteristic adjustment process which has higher versatility so as to be able to correspond to such variation of adjustment situations, and further, shifts the characteristic to the standard value with good precision.

Also, it is desired to avoid visual unevenness when an observer watches a displayed image.

This invention was made to solve the above-described problems of the conventional technology, and has an object to provide a method of manufacturing an image forming apparatus which adjusts a characteristic of a multiple electron source in a matter of minutes, and uniforms an in-plane luminance characteristic of image display.

SUMMERY OF THE INVENTION

The present invention is a method for manufacturing an image forming apparatus having a multiple electron source in which a plurality of emitters are disposed on a substrate and fluorescent materials for emitting light by irradiation of electron beam from the multiple electron source, comprising: a first measurement step of measuring change of luminance, when a pulse having a plurality of amplitudes larger than drive voltage is applied to the predetermined number of the emitters, with respect to the amplitude of the pulse and the number of the pulse; a step of preparing, on the basis of the measurement result of the first measurement step, a look-up table for storing the amplitude of the pulse and the number of the pulse for shifting characteristic of emitters to a predetermined luminance target value; a second measurement step of measuring the luminance when the drive voltage is applied to the emitter; and step of applying, on the basis of the measurement result of the second measurement step, characteristic shift voltage comprising a plurality of pulses in which the amplitude of the pulse obtained from the: look-up table has two or more values, to the emitter.

Another aspect of the present invention is a method for manufacturing an image forming apparatus having a multiple electron source in which a plurality of emitters are disposed on a substrate and fluorescent materials for emitting light by irradiation of electron beam from the multiple electron source, comprising: a first measurement step of measuring change of luminance, when a pulse having a plurality of amplitudes larger than drive voltage is applied to the predetermined number of the emitters, to the amplitude of the pulse and the number of the pulse; a step of preparing, on the basis of the measurement result of the first measurement step, a look-up table for storing the amplitude of the pulse and the number of the pulse for shifting characteristic of emitters to a predetermined luminance target value; a second measurement step of measuring the luminance when the drive voltage is applied to the emitter; and a step of applying, on the basis of the measurement result of the second measurement step, characteristic shift voltage comprising a plurality of pulses in which pulse width of the pulse obtained from the look-up table has two or more values, to the emitter.

Another aspect of the present invention is a method for manufacturing an image forming apparatus having a multiple electron source in which a plurality of emitters are disposed on a substrate and fluorescent materials for emitting light by irradiation of electron beam from the multiple electron source, comprising: a step of measuring change of luminance with respect to each of characteristic shift voltages and preparing a luminance adjustment rate table, when a plurality of characteristic shift voltages which have different voltage values larger than drive voltage are applied to the predetermined number of the emitters; a step of measuring luminance to set luminance target value L0 and obtaining maximum luminance Lmax, when the drive voltage is applied to the emitter; a step of determining maximum adjustment shift voltage and a group of the adjustment shift voltage with smaller voltage values than the maximum adjustment shift voltage, by referring to the luminance adjustment rate table with maximum adjustment rate Dmax of luminance of Dmax=L0/Lmax, and a step of applying the adjustment shift voltage selected from the adjustment shift voltage group to the emitter.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

Hereinafter, with reference to the drawings, preferred embodiments of this invention will be explained in an illustrating manner and in detail. But, there is no intention to limit a scope of this invention to dimensions, materials, and shapes of components described in the embodiments, relative configurations thereof, and so on, unless otherwise described specifically.

(First Embodiment)

A first embodiment will be explained with reference to FIG. 1 to FIG. 9.

In the first embodiment and second and third embodiment which will be described later, used is a display panel in which SCE-emitters were disposed. Since a structure and a manufacturing method of the display panel of an image forming apparatus to which the invention was applied are described in detail in the above-described literature 1 and literature 2, they will be omitted.

A concrete structure of the embodiment will be described in detail.

Inventors of the present invention found, in advance of a normal drive in a manufacturing process, that variation over time can be reduced by carrying out a preliminary drive processing.

In the embodiment, since adjustment of characteristics and the preliminary drive of the electron source is carried out integrally, firstly, the preliminary drive will be described briefly.

In addition, detail of the preliminary drive is described in the above-described literature 2.

After energization forming process and energization activation process, the emitter is held in a stable situation with reduced partial pressure of an organic matter. An energization process which is applied in advance of the normal drive under an atmosphere with reduced partial pressure of the organic matter in such vacuum atmosphere (stable situation) is the preliminary drive.

After the drive is carried out for a while with voltage of the preliminary drive voltage Vpre, the normal drive is carried out at the normal drive voltage Vdrv so as to lessen electric field strength.

It seems that, by carrying out the drive in advance with large electric field strength for an electron emission part of the emitter by use of such drive using application of Vpre voltage, changes of constituent members which causes instability of a time-lapse characteristic are caused in a brief period of time and in a concentrated manner, and variable factors at the time of long-hour drive with the normal drive voltage Vdrv which causes a low electric field can be reduced.

In the embodiment, in case that, in advance of using the emitters in the image forming apparatus, variation of characteristics of respective emitters occurs when the normal drive voltage Vdrv is applied, adjustment of characteristics of respective emitters is carried out so as to reduce the variation and to have a uniform distribution.

Firstly, a drive circuit for adjusting the characteristic will be described.

Figure 3:
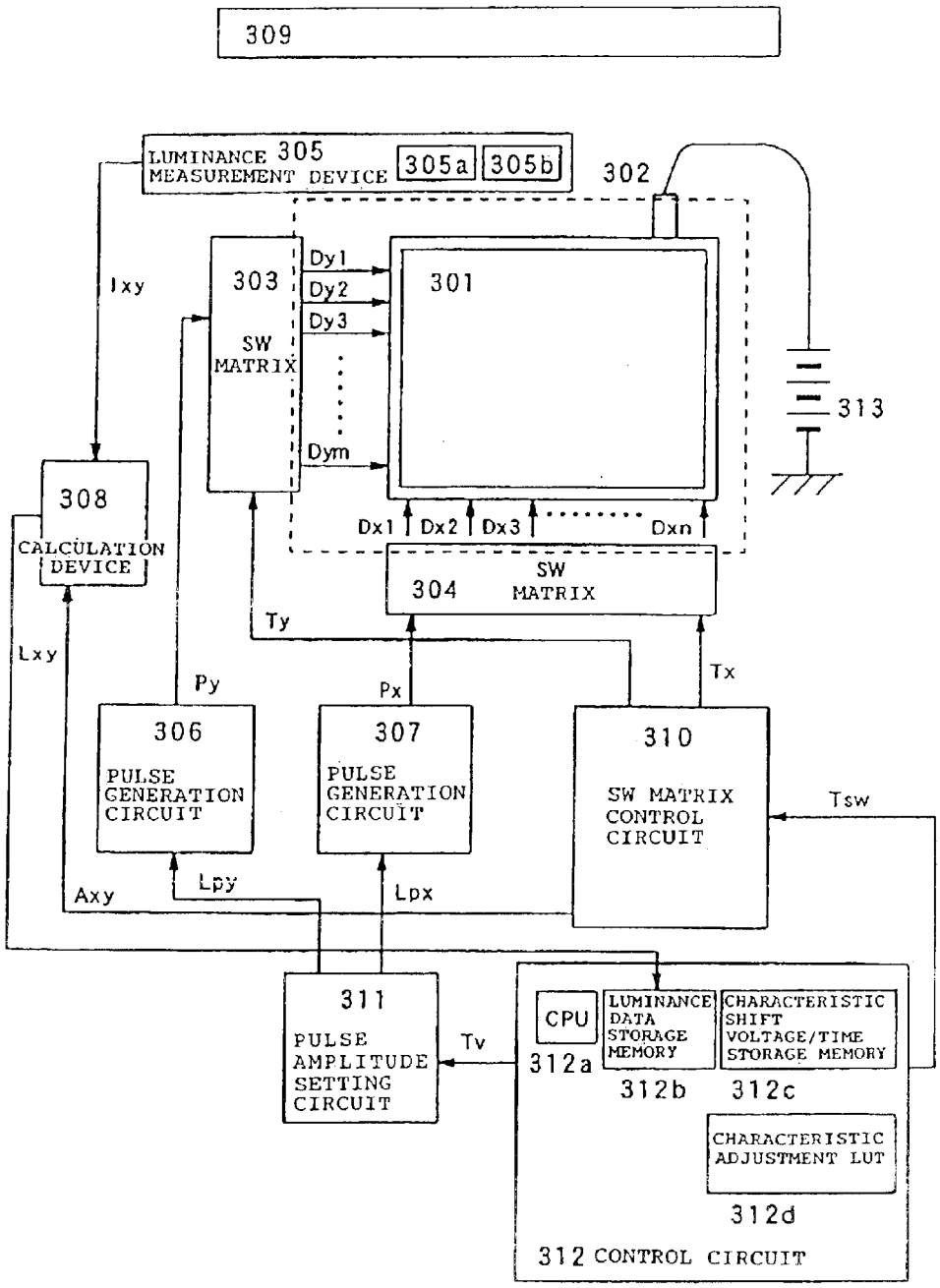
FIG. 3 is a schematic structural view of an apparatus for applying the characteristic adjustment signal to an image forming apparatus using a multiple electron source relating to the first embodiment.

FIG. 3 is a block diagram showing a structure of the drive circuit for changing luminance characteristic of individual SCE-emitter of a multiple electron source by applying a wave form signal for adjusting the characteristic to each SCE-emitter of a display panel 301.

In FIG. 3, in the display panel 301, a substrate in which a plurality of SCE-emitters were disposed in a matrix and face plates which were disposed above the substrate at a distance and have fluorescent materials emitting light by electrons emitted from the SCE-emitters and so on are disposed in a vacuum container. To each emitter of the display panel 301, in advance of adjusting the characteristic, the preliminary drive voltage Vpre is applied.

A terminal 302 is a terminal for applying high voltage to the fluorescent materials of the display panel 301 from a high voltage power supply 313.

Switch matrixes 303 and 304 select a row direction wiring and a column direction wiring, respectively and the emitter to which a pulse voltage is applied.

Pulse generation circuits 306 and 307 generate pulse wave form signals Px and Py for driving use.

A luminance measurement device 305 is one for getting light emission of the display panel 301 and carrying out photoelectric sensing, and comprises an optical lens 305*a* and an area sensor 305*b*. For example, as the area sensor 305*b*, CCD can be used.

By use of this luminance measurement device 305, a condition of light emission of the display panel 301 is digitized as 2-dimentional image information.

An calculation device 308 calculates information of light emission amount corresponding to each SCE-emitter which was driven by inputting 2-dimensional image information Ixy as an output of the area sensor 305*b* and position information Axy which were designated in the switch matrixes 303 and 304 from a switch matrix control circuit 310, and outputs to a control circuit 312 as Lxy.

A robot system 309 is one which moves the area sensor 305*b* relatively to the display panel 301, and comprises not-shown a ball screw and a linear guide.

A pulse amplitude setting circuit 311 determines amplitudes of pulse signals outputted from the pulse generation circuits 306 and 307, respectively, by outputting pulse setting signals Lpx and Lpy.

The control circuit 312 controls an entire procedure of adjusting the characteristic, and outputs data Tv for setting amplitude to the pulse amplitude setting circuit 311. The control circuit 312 has CPU 312*a*, a luminance data storage memory 312*b*, a memory 312*c* and characteristic adjustment look-up table (LUT) 312*d*.

The CPU 312*a* controls an operation of the control circuit 312.

The luminance data storage memory 312*b* stores light emission characteristic of each emitter for adjusting the characteristic of each emitter. Specifically, the luminance data storage memory 312*b* stores light emission data which is in proportion to the luminance of light emission emitted by electrons discharged from each emitter at the time of application of the normal drive voltage Vdrv.

The memory 312*c* stores the characteristic shift voltage necessary for reaching to the target setting value.

The characteristic adjustment LUT 312*d* is, as described later, one which is referred to in carrying out the characteristic adjustment of the emitters.

The switch matrix control circuit 310 selects the emitter to which the pulse voltage is applied, by outputting switch change-over signals Tx and Ty and controlling selection of a switch in the switch matrixes 303 and 304. Also, it outputs the position information Axy showing which emitter was made to be turned on to the calculation device 308.

Next, an operation of this drive circuit will be described. The operation of this circuit has a stage in which luminance of emitted light of each SCE-emitter of the display panel 301 is measured and luminance variation information necessary for reaching adjustment target value is obtained, and a stage in which a pulse wave form signal for shifting the characteristic is applied so as to reach the adjustment target value.

Firstly, a method of measuring the luminance of emitted light will be described. At the beginning, by the robot system 309, the luminance measurement device 305 is moved so as to be located in an opposite position above the display panel 301 which is desired to be measured. Next, by a switch matrix control signal Tsw from the control circuit 312, the switch matrix control circuit 310 selects a given row direction wiring or column direction wiring by use of the switch matrixes 303 and 304, and SCE-emitter of a desired address is switched to be connected so as to be driven.

On the other hand, the control circuit 312 outputs the amplitude data Tv for use in measuring the electron emission characteristic to the pulse amplitude setting circuit 311. Thereby, the amplitude data Lpx and Lpy are outputted from the pulse amplitude setting circuit 311 to the pulse generation circuits 306 and 307, respectively. Based upon these amplitude data Lpx and Lpy, the pulse generation circuits 306 and 307 output drive pulses Px and Py, respectively, and these drive pulses Px and Py are applied to an emitter which is selected by the switch matrixes 303 and 304.

Here, these drive pulses Px and Py are set so as to become pulses of ½ amplitude of voltage (amplitude) Vdrv which is applied to the SCE-emitter for characteristic measurement and of different polarities from each other. Also, at the same time, by the high voltage power supply 313, predetermined voltage is applied to the fluorescent materials of the display panel 301.

This process of address selection and pulse application is repeated for a plurality of the row wirings and a rectangular area of the display panel 301 is driven with being scanned.

And, a signal Tsync indicating a period of this repeated process is handed over to the area sensor 305*b* as a trigger of an electronic shutter. That is, the control circuit 312, as shown in FIG. 3, outputs the drive signal in synchronous with Tx and Ty, and outputs Ty sequentially for the number of the row wirings. The Tsync signal is outputted so as to cover the plural Ty signals. Since a shutter of the area sensor 305*b* is opened during a period that Tysnc is in logical High, on the area sensor 305*b*, a lighting image which was reduced through the optical lens 305*a* is formed.

Figure 5:
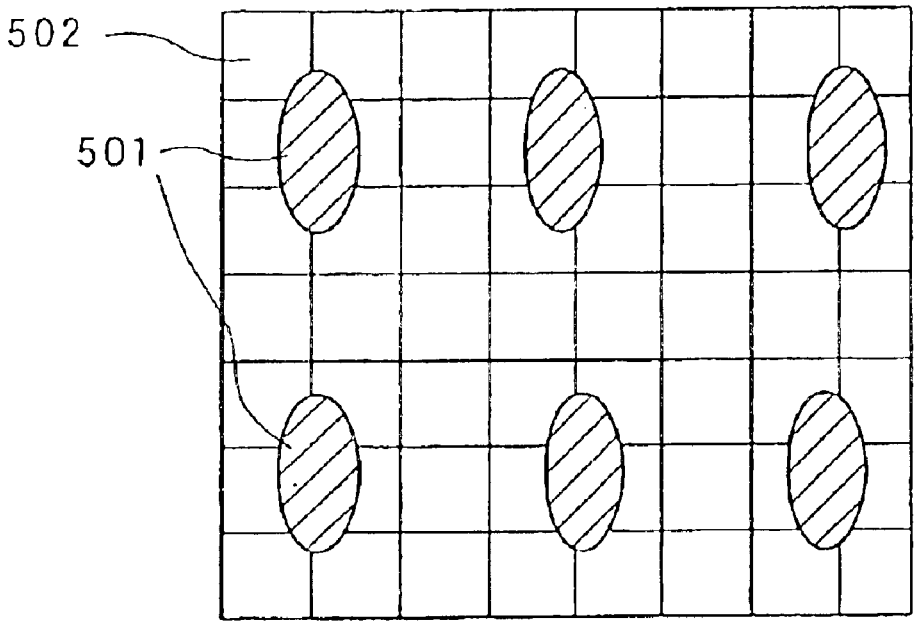
FIG. 5 is a schematic view showing an appearance that a luminescent spot on the image forming apparatus was projected on an area sensor relating to the first embodiment.

Such situation is schematically shown in FIG. 5. Reduction scale factor of an optical system is set so that one light-emission point 501 is formed on a plurality of elements 502 of the area sensor 305*b*.

A 2-dimensional image information Ixy as this picked-up image is transferred to the calculation device 308. Since an image of the element driven is formed, if sum of the elements assigned is calculated, obtained is luminance value which is in proportion to light-emission amount of the element driven. Since the luminance value corresponding to the driven element of the rectangular area can be obtained in this way, information is sent as Lxy to the control circuit 312.

Although the electric shutter is opened also during afterglow period of the fluorescent materials, since the light-emission points are separated spatially from each other on the area sensor 305*b*, there was no case that effect of the after-glow period appears between the light-emission points.

Next, a method of adjusting the characteristic will be described with reference to FIGS. 1, 2, and 6.

Figure 1:
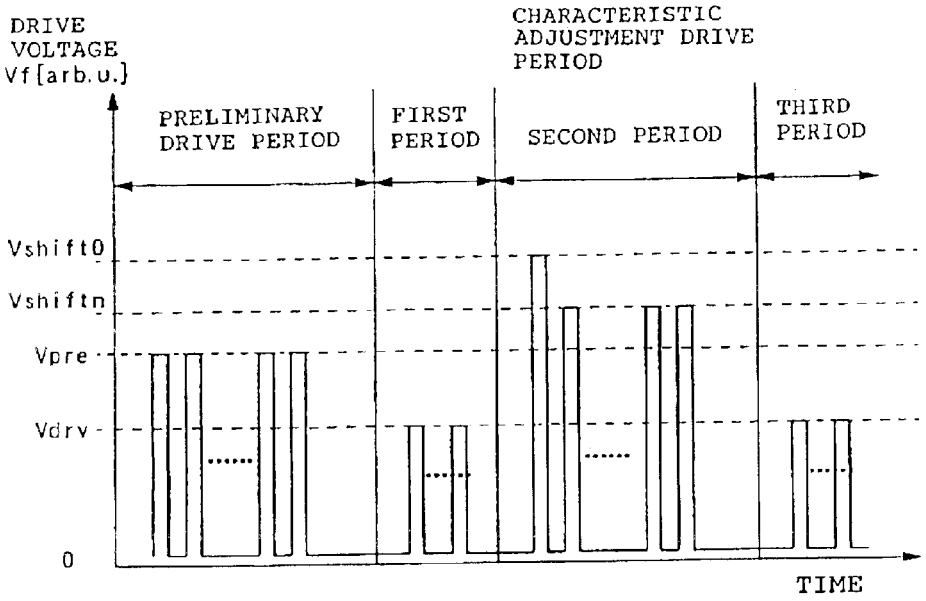
FIG. 1 is a view showing one example of a characteristic adjustment signal of a SCE-emitter relating to a first embodiment.

FIG. 1 is a graph showing a wave form of the preliminary drive and characteristic shift voltage which is applied to one SCE-emitter, focusing attention on one of the SCE-emitters constituting the multiple electron source, and a horizontal axis represents time and a vertical axis represents the voltage which was applied to the SCE-emitter (hereinafter, represented by emitter voltage Vf).

Here, as the drive signal, a continuous rectangular voltage pulse as shown in FIG. 1 is used, and a period of applying a voltage pulse of the characteristic adjustment drive period is divided into three of a first period to a third period, and in each period, 1 to 1000 pulses are applied. Depending upon the emitter, the pulse amplitude applied differs.

Here, the emitter voltage Vf is set to be Vf=Vpre during the preliminary drive period, and to be Vf=Vdrv during the first and the third period of the characteristic adjustment period, and to be Vf=Vshift (Vshift varies timewise) during the second period.

These emitter voltages Vpre, Vdrv, and Vshift are voltages larger than electron emission threshold voltage of the SCE-emitter. And, the emitter voltage Vpre, Vdrv, and Vshift are set to meet with a condition of $Vdrv<Vpre\leqq Vshift$. But, since the electron emission threshold voltage depending upon shapes and materials of the SCE-emitters, it is properly set in conformity with the SCE-emitter which becomes an object to be measured.

Detail of each period of the characteristic adjustment period in FIG. 1 will be described.

(First Period Characteristic Evaluation Period in Operation Voltage)

The first period is a period in which, after application of the preliminary drive voltage, evaluated is the emitter characteristic on the occasion that the drive voltage was decreased to the normal drive voltage Vdrv as the normal operation voltage. The normal drive voltage (Vdrv) pulse is applied to the emitter and the luminance Lc at the time of application of Vdrv voltage is measured. The pulse of a waveform for measuring the emitter characteristic can be obtained by applying about 1 to 10 shots.

(Second Period Characteristic Shift Voltage Application Period)

In the second period, for the method of adjusting the characteristic of the electron emission characteristic, by use of a memory function of the electron emission characteristic, the voltage value Vshift (Vshift1→Vshift2→ . . . Vshiftn) larger than the preliminary drive voltage Vpre is applied so that the electron emission characteristic of the emitter is shifted.

Accordingly, the second period and the third period are not applied to the emitter which is not necessary for adjusting the characteristic.

As to the pulse of waveform for shifting the electron emission characteristic of the emitter, the number of pulses properly set by changing the characteristic shift voltage Vshift is applied. Here, if the number of pulses is about 2 to 1000 shots, process time does not become long, which is proper.

(Third Period After Application of Characteristic Shift Voltage, Characteristic Evaluation Period in Operation Voltage)

The third period is a period in which, after the application of the characteristic shift voltage, evaluated is the emitter characteristic on the occasion that the drive voltage was decreased to the normal drive voltage Vdrv as the normal operation voltage. In the same manner as the first period, the pulse of the normal drive voltage Vdrv is applied to the emitter and the luminance at the time of application of Vdrv voltage is measured. In addition, the third period may be omitted as the manufacturing method.

After the above-described drive is carried out to one emitter, similar process is applied to all emitters and thereby, the characteristic adjustment process to the multiple electron sources is completed.

Here, the application of the characteristic shift voltage may be carried out simultaneously to the plurality of emitters. For example, a desired voltage is applied to certain row direction wiring, and voltage is applied to each column direction wiring so that necessary voltage can be applied to each emitter connected to this row direction wiring, and thereby, it is possible to apply different voltages to the plurality of the emitters simultaneously.

Figure 2:
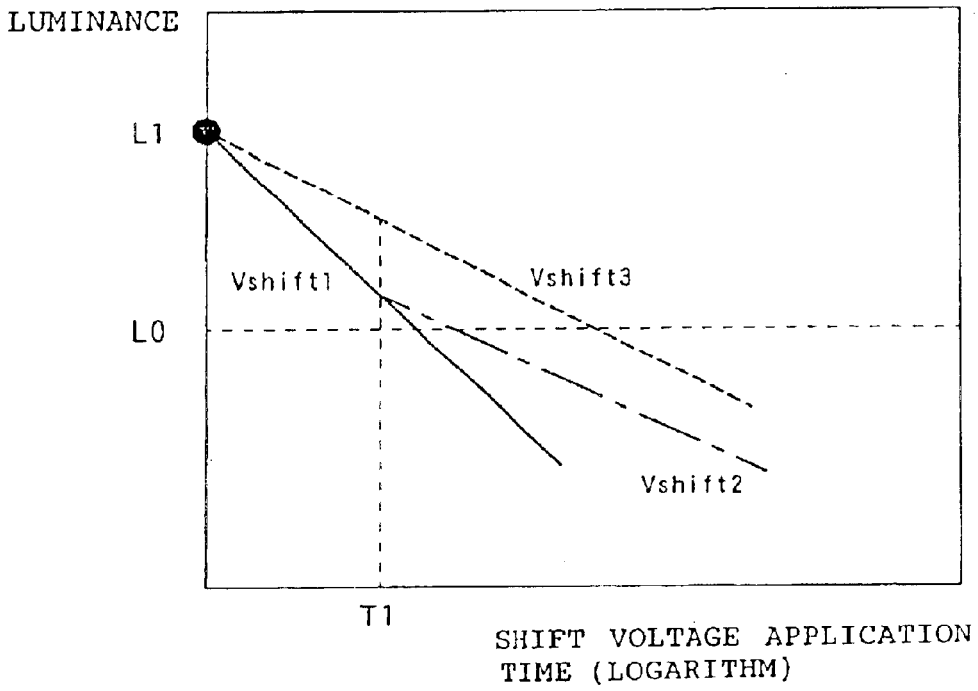
FIG. 2 is a graph showing schematically correlation of luminance, shift voltage and applied time.

There is a correlation between time for applying the shift voltage to be applied at the time of characteristic adjustment and the shift amount of the luminance, and FIG. 2 is a graph showing schematically correlation of the luminance and the shift voltage value and the time for applying the shift voltage at the time of applying the characteristic shift voltage Vshift of magnitude larger than the electron emission threshold voltage value. An X axis of the graph of FIG. 2 represents the time for applying the shift voltage in logarithmic manner, and a Y axis represents the luminance.

In FIG. 2, change over time of shift amount when the characteristic shift voltage of Vshift1 was applied to the emitter having a characteristic of initial luminance L1 is shown by a solid line. Also, change over time of shift amount when the characteristic shift voltage of Vshift3 was applied is shown by a broken line. Further, temporal change of shift amount when the characteristic shift voltage of Vshift1 was applied until time T1 and thereafter, the characteristic shift voltage of Vshift2 was applied is shown by a dot-dash-line. Here, relation of Vshift1>Vshift2, Vshift3 is satisfied.

As shown in FIG. 2, it is seen that, the more the shift voltage value is, the characteristic shift amount is increased, and by changing the characteristic shift voltage in mid course of the adjustment of the characteristic, variation of the shift amount is changed.

Also, in case that the target value is set to be the luminance L0, when the characteristic adjustment drive is carried out only by the characteristic shift voltage of Vshift1, variation of the shift amount to the time for applying the voltage is enlarged, and it has to carry out stringently the control to the time for applying the shift voltage. Further, it is seen that the shift amount differs greatly depending upon variation of slight change of the shift amount.

Also, when the characteristic adjustment drive is carried out only by the characteristic shift voltage of Vshift3, variation of the shift amount to the time for applying the shift voltage is lessened and much more time is required to shift the characteristic to the target value L0.

In contrast to this, by changing the characteristic shift voltage to Vshift2 after the voltage of Vshift1 was applied until certain time T1 for applying the shift voltage, the shift to vicinity of the target value L0 is carried out for a short period of time, and thereafter, in the course of shifting from the vicinity of L0 to the target value L0, there occurs moderate variation of the shift amount to time, and margin to the control of time for applying is generated, and margin to the variation of the change of the shift amount is increased. If this characteristic change is used, it is possible to make the luminance to a specific value in the normal drive voltage Vdrv during the third period, by increasing and decreasing voltage applied to the emitter of the pulse of Vshift during the second period.

The multiple electron source is constituted by many emitters, and characteristics after the preliminary drive was applied differ, respectively. The inventors of the present invention devoted themselves to study how the luminance changes, in case that the characteristic shift voltage was applied to the emitters whose electron emission characteristics after the preliminary drive differ, respectively.

As a result of this, the inventors of the present invention found that rate of characteristic change on the occasion that the characteristic shift voltage was applied is generally constant, whether the luminance before the shift voltage was applied is high or low. If this characteristic is used, it is possible to apply a variation curve of the same discharge current characteristic also to the emitters with somewhat different initial luminance and carry out the adjustment of the emitter characteristic.

Then, in the embodiment, firstly, certain emitters of the multiple electron source are used, and a time-variation curve of the luminance to a plurality of the characteristic shift voltages is obtained, and further, a variation curve of the luminance when different characteristic shift voltage is applied is obtained after the characteristic shift voltage is applied for a given length of time, and based upon them, it is possible to carry out the characteristic adjustment of the entire multiple electron source.

In short, the process comprises a stage (corresponds to the preliminary drive period and the first period of the characteristic adjustment period of FIG. 1) in which, after the preliminary drive voltage Vpre is applied to all SCE-emitters of the display panel 301, the luminance at the time of applying the normal drive voltage Vdrv is measured, and standard target luminance upon carrying out the characteristic adjustment is set, and a stage in which, by use of certain emitters at a place which hardly produce any troubles upon displaying images, derived is variation of the luminance when the characteristic shift voltage Vshift and the normal drive voltage Vdrv are applied alternately to make the look-up table, and a stage (corresponds to the second and third periods of the characteristic adjustment period of FIG. 1) in which, in compliance with the look-up table for adjusting the characteristic, the pulse wave form signal of the characteristic shift voltage Vshift is applied and the normal drive voltage Vdrv is applied for judging whether the characteristic adjustment is completed so that the electron emission characteristic is measured.

Firstly, the stage in which, after the preliminary drive voltage Vpre is applied to all SCE-emitters of the display panel 301, the luminance at the time of applying the normal drive voltage Vdrv is measured, and standard target luminance upon carrying out the characteristic adjustment is set (corresponds to the preliminary drive period and the first period of the characteristic adjustment period of FIG. 1) will be described.

The switch matrix control signal Tsw is outputted, and the switch matrixes 303 and 304 are switched by the switch matrix control circuit 310, and thereby, one of the SCE-emitters is selected in the display panel 301.

Next, the data Tv of the pulse signal which is applied to the selected emitter and set in advance is outputted to the pulse amplitude setting circuit 311. And, by the pulse generation circuits 306 and 307, through the switch matrixes 303 and 304, the pulse signal of the preliminary drive voltage value Vpre is applied to the selected SCE-emitter.

In order to carry out the luminance measurement when the preliminarily driven emitter is driven by decreasing to the normal drive voltage Vdrv, as the data Tv of the pulse signal which is applied to the selected emitter and set in advance, the normal drive voltage value Vdrv is set. And, the pulse signal of the normal drive voltage value Vdrv is applied to the selected SCE-emitter. Thereafter, in order to adjust the characteristic, the luminance at Vdrv voltage is stored in the luminance data storage memory 312*b*. Here, measurement of the luminance is carried out by use of the above-described area sensor 305*b*.

When measurement processing to all SCE-emitters is completed, to the all SCE-emitters of the display panel 301, the luminance at the normal drive voltage Vdrv is compared, and the luminance target value L0 is set.

It is also possible to set the luminance target value L0 to be the luminance of the emitter which shows minimal luminance to the drive voltage out of the emitters to be used for the image display but, in this embodiment, electron emission current values of all emitters are processed statistically, and by calculating its average luminance L-ave and standard deviation σ-L, the luminance target value L0 is set as follows.

$$L0=(L\text{-ave})-(\sigma\text{-}L)$$

By setting the luminance target value L0 like this, without greatly decreasing the average luminance of the multiple electron sources after the characteristic is adjusted, it is possible to decrease variation of the electron discharge amount of individual emitters.

Next, a procedure for measuring the luminance when a plurality of characteristic shift voltage is applied (1 to 1000 pulses) to a plurality of SCE-emitters in the place 301*a* which hardly produce any troubles upon displaying images on the display panel 301 and a stage of obtaining data of relation of the characteristic shift voltage and the shift amount for preparing the look-up table for adjusting the characteristic from the data will be described.

At the beginning, it is properly determined the pulse width of the characteristic shift voltage, the amplitude of the characteristic shift voltage, and how many pulses of different several amplitudes are applied to individual emitters. Here, a case that, as the characteristic shift voltage, different two amplitudes are applied with one pulse and nine pulses, and the characteristic is adjusted with ten pulses in total will be described as one example.

On obtaining data for preparing the look-up table, firstly, as the characteristic shift voltage, discrete voltage values of four steps (Vshift1 to Vshift4) are selected and the characteristic shift amount is observed with respect to each voltage.

Thereafter, by applying characteristic shift voltages of three steps (Vshift1' to Vshift3') which are different from respective characteristic shift voltages, the characteristic shift amount after that was observed.

Here, range of the characteristic shift voltage is, as described above, of Vshift≧Vpre, and range of Vshift voltage is properly set depending upon shapes and materials of the SCE-emitter but, normally, the characteristic can be adjusted by setting it with several steps having step width of about 1V.

Also, a case that, as the characteristic shift voltage, Vshift of four steps and Vshift' of three steps are set will be described. However, there is no problem if both of Vshift and Vshift' comprise a plurality of steps.

A procedure for measuring change amount of the luminance when four characteristic shift voltages Vshift1, Vshift2, Vshift3 and Vshift4 are applied to a plurality of the SCE-emitters, respectively, and thereafter, the characteristic shift voltages (Vshift1' to Vshift3') of three stages which are different from respective characteristic shift voltages are applied will be described.

Firstly, set are an area in which each of the four characteristic shift voltages are applied to the plurality of the SCE-emitters, the number of the emitters, respective characteristic shift voltage values, pulse width values and the number of pulses applied.

As an area in the display panel 301 in which each of 4×3 characteristic shift voltages is applied to the plurality of the SCE-emitters, the place 301*a* which hardly gives no trouble upon displaying images is selected, and the number of the emitters is set to twenty-one (21) emitters to one characteristic shift voltage.

The switch matrix control signal Tsw is outputted and the switch matrixes 303 and 304 are switched by the switch matrix control circuit 310, and thereby, one of the SCE-emitters is selected in the display panel 301.

The data Tv of the pulse signal which is applied to the selected emitter and set in advance is outputted to the pulse amplitude setting circuit 311. The amplitude of the pulse for the characteristic shift voltage is a amplitude of the preliminary drive voltage value Vpre, any one of the characteristic shift voltage values Vshift1, Vshift2, Vshift3, and Vshift4, or any one of Vshift1', Vshift2', and Vshift3', and the number of pulses is properly set to be one and more.

To the selected SCE-emitter, from the pulse generation circuits 306 and 307 through the switch matrixes 303 and 304, the pulse signal of the preliminary drive voltage value Vpre is applied as a first time of the characteristic shift voltage.

Next, in order to carry out evaluation of the luminance characteristic at the time when the emitter to which the characteristic shift voltage was applied was driven by decreasing to the normal drive voltage Vdrv, set is the data Tv of the pulse signal which is applied to the selected emitter and set in advance.

Also, to the selected SCE-emitter, the pulse signal of the normal drive voltage value Vdrv is applied. The luminance at Vdrv voltage is stored in the luminance data storage memory 312*b* as variation data of the electron emission amount in response to the application of the characteristic shift voltage.

It is investigated whether the characteristic shift voltage was applied with predetermined number of times to the selected SCE-emitter, and if not, it goes on to the step for applying the characteristic shift voltage. On one hand, when the number of times for the application of the characteristic shift voltage reached the predetermined number one, it is investigated whether or not variation of the electron emission amount was measured for a plurality of predetermined SCE-emitters, and if not, set is the switch matrix control signal Tsw for selecting next SCE-emitter.

On the other hand, when measurement processing to the predetermined SCE-emitters has been completed, variation amount of the luminance when each of the four characteristic shift voltages Vshift1, Vshift2, Vshift3 and Vshift4 (one pulse) were applied to the plurality of the predetermined SCE-emitters, and variation amount of the luminance by the characteristic shift voltages Vshift1', Vshift2' and Vshift3' applied thereafter are plotted to prepare a graph.

Figure 6A:
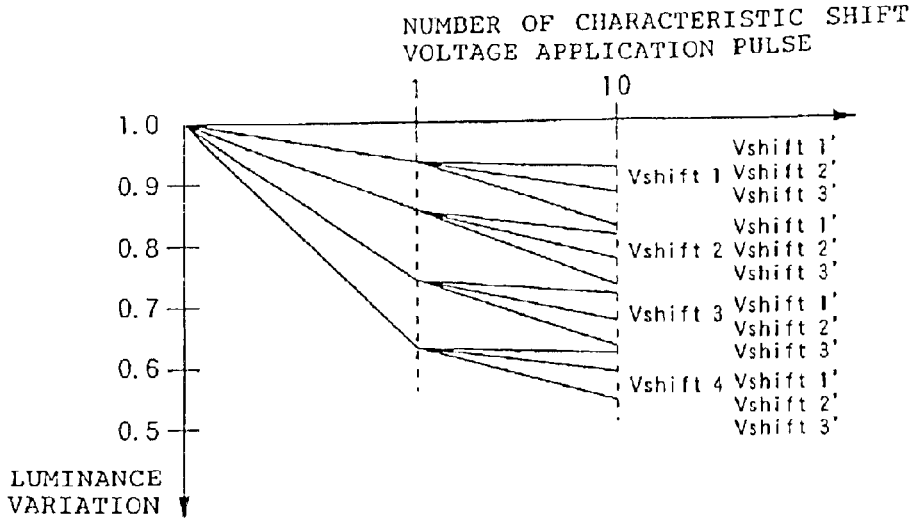
FIGS. 6A to 6C show characteristic curves illustrating variation of luminance with respect to each drive voltage when several kinds of the drive voltages were continuously applied.

FIG. 6A shows relation of variation of the luminance after each of the four characteristic shift voltages Vshift1, Vshift2, Vshift3 and Vshift4 was applied to the plurality of the SCE-emitters and variation (average value) of the luminance when Vshift1', Vshift2' and Vshift3' were applied after the application of the four characteristic shift voltages. In addition, the luminance at this time is a value which was measured when they are normally driven with Vdrv after each application of one pulse of each characteristic shift voltage.

Next, a process for adjusting the characteristic of the entire multiple electron sources will be described. As shown in FIG. 6, variation of the characteristic of the emitter is enlarged by increasing the number of the characteristic shift voltage application pulses or by enlarging the characteristic shift voltage. That is, adjustment amount is enlarged. The characteristic adjustment of the entire multiple electron source by use of the characteristic variation curves shown in FIG. 6 is carried out by the following two steps.

(1) The characteristic shift voltage is set on the basis of the target luminance L0 which was set from the luminance measurement result. That is, this step is the stage for preparing the look-up table for the characteristic adjustment.

(2) On the basis of the set value which was determined in (1), the characteristic shift voltage is set with respect to each emitter. And, by applying the characteristic shift voltage, the characteristic is shifted to the target value. That is, it becomes the stage (corresponds to the second period of the characteristic adjustment period of FIG. 1) for applying the pulse wave form signal of the characteristic shift voltage Vshift in response to the look-up table for the characteristic adjustment.

But, as described above, there exist a small number of electron sources in which rates of changes to the characteristic shift voltage in the characteristic variation curves shown in FIG. 6 differ greatly. Even as to such electron sources, by incorporating a way, described later, of coping with them into the steps (1) and (2) for adjusting the characteristic of large majority of the electron sources, it becomes possible to adjust the characteristic thereof.

The steps (1) and (2) will be described in detail.

(1) When the luminance L1 which was measured after the preliminary drive is tried to be reached the target value L0, necessary shift amount becomes D=L0/L1.

Thereafter, slightly small value to the necessary shift amount, here, the shift amount of 0.9×D is set. Here, a reason why the shift amount is set to 90% is that, even if the ratio of change of the characteristic to the applied pulse differs by about 10%, it does not become less than the target value, and this value is properly set from variation of the change ratio.

Figure 6B:
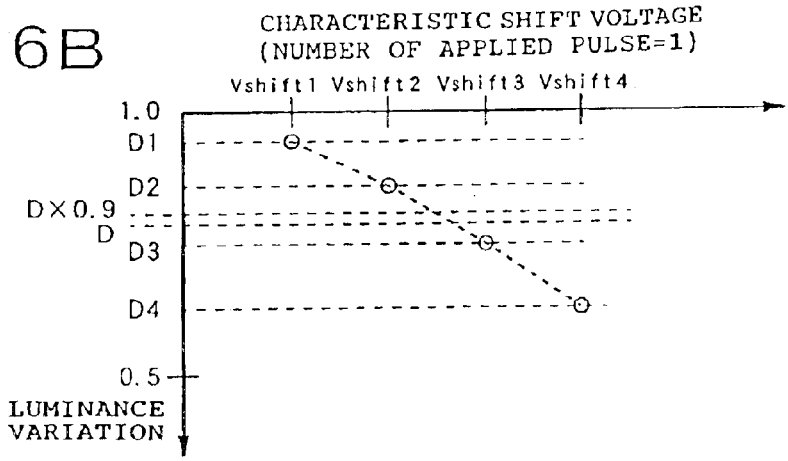

On the basis of the graph of FIG. 6B, Vshift voltage is determined from the shift amount of 0.9×D.

By determining Vshift voltage from a range of the shift amount calculated as follows, it is possible to suppress a fact that the SCE-emitter gets down to less than the target value by initial one pulse.

That is, Vshift1 corresponds to a range of $D1 \leqq 0.9 \times D < D2$, Vshift2 corresponds to a range of $D2 \leqq 0.9 \times D < D3$, Vshift3 corresponds to a range of $D3 \leqq 0.9 \times D < D4$, and Vshift4 corresponds to a range of $D4 \leqq 0.9 \times D$.

They are so determined respectively.

Figure 6C:
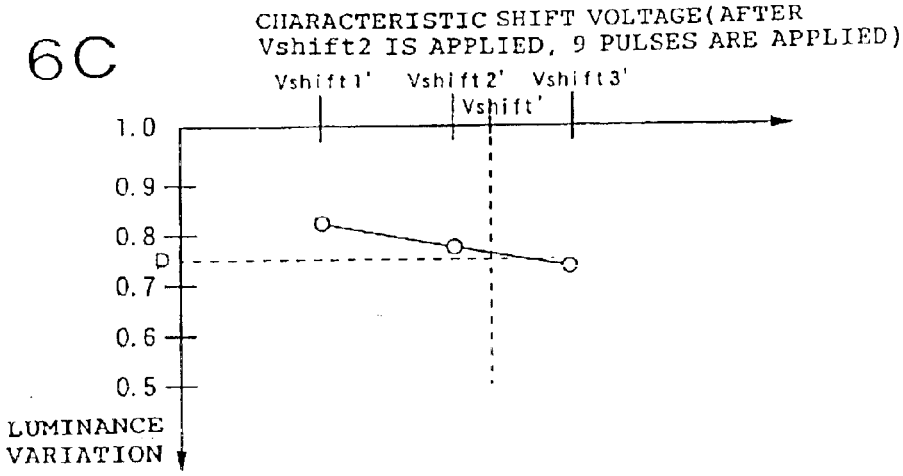

Next, from the shift amount when Vshift' voltage was applied after the application of Vshift voltage as shown in FIG. 6C, Vshift' which becomes the shift amount D to be targeted is calculated.

As described above, Vshift and Vshift' can be determined from the initial luminance L1.

In short, for example, to the SCE-emitter which requires the shift amount of D, D×0.9 becomes D2<D×0.9<D3 from FIG. 6B, and therefore Vshift is determined as Vshift=Vshift2.

Here, described was a case that as Vshift, a discrete value is set and as Vshift', an analog value is set but, this embodiment is not limited to such a case and discrete values may be used for both of them.

Next, if voltage corresponding to D is obtained from FIG. 6C, it is appropriate to apply Vshift2 (1 msec-one pulse) and Vshift' (1 msec-nine pulses) to the SCE-emitter which requires the shift amount of D.

By doing the foregoing, the look-up table for adjusting the characteristic of the initial luminance L1 is prepared.

(2) Referring to the look-up table, by applying the characteristic shift voltage to individual emitters in response to each characteristic of the emitters, drive adjustment is carried out.

Also, as described above, a method of coping with the emitters in which the ratios of changes to the characteristic shift voltage differ greatly will be described.

Firstly, in order to estimate whether or not the electron source is such one whose characteristic adjustment is not completed, compared are the shift amount calculated from the luminance L1' which was measured by applying the normal drive voltage Vdrv after the first time characteristic shift voltage was applied and estimated shift amount. Assuming that the estimated shift amount is Dn, actual shift amount Dr, from the initial luminance L1 and luminance L1' after the application of one pulse of the characteristic shift voltage Vshift, becomes Dr=L1'/L1.

A difference ΔD of the shift amounts is described as ΔD=Dn−Dr.

It has been found that the electron sources with different shift amounts have different shift amounts with substantially the same ratio to the shift voltage values. Then, a value of the shift amount to be targeted multiplied with Dn/Dr, D×Dn/Dr is assumed as shift amount correction value, and the characteristic shift voltage Vshift' is determined from FIG. 6C. Also, with regard to an emitter the luminance of which has already become less than the target luminance L0 at this point, the application of Vshift' is not carried out.

By doing as described above, uniformity can be achieved including the emitters in which the ratios of changes to the characteristic shift voltage differ greatly.

Also, here, described was a case that the measurement of the actual shift amount is carried out at the first time but, the invention is not limited to such a case, and there is no problem to carry out the process for correcting from the actual shift amount whenever the characteristic shift voltage is applied by any times.

Figure 10A:
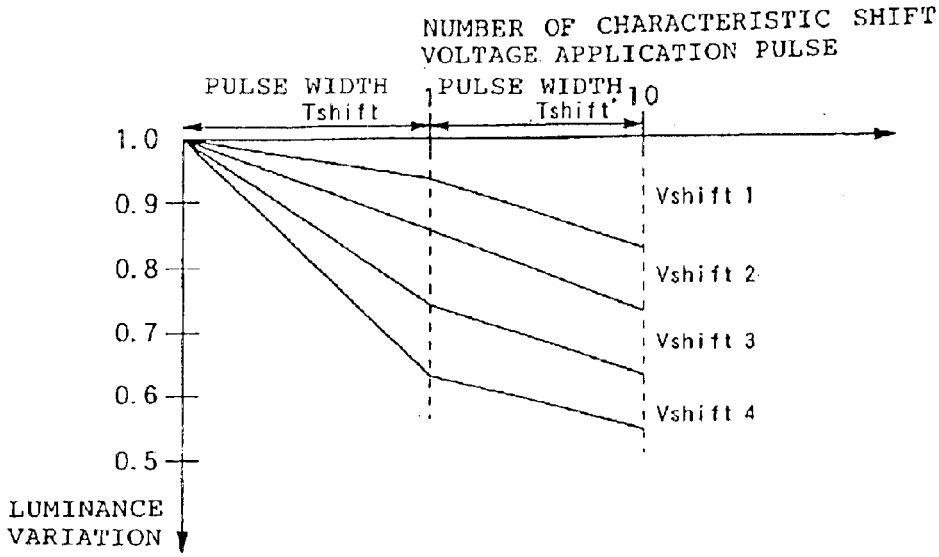
FIGS. 10A and 10B show characteristic curves illustrating variation of luminance with respect to each drive voltage when several kinds of the drive voltages were continuously applied.

In addition, in this embodiment, the procedure was that the characteristic adjustment look-up table is prepared with respect to each display panel 301, and on the basis of the characteristic adjustment look-up table, the characteristic adjustment is carried out. However, in this embodiment and a second embodiment which will be described later, in case that the characteristic adjustment is carried out by setting the luminance target values L0 of the emitters to the same values in the display panels 301 of the same lot, the characteristic adjustment look-up table is prepared only for the first one piece of the display panel, and in display panels of a second one and thereafter, if the measurement result of the electron emission characteristic at the time of application of the normal drive voltage Vdrv after the preliminary drive voltage Vpre is applied to all SCE-emitters of the display panel 301 is in a range of being capable of setting to the luminance target value L0 of the SCE-emitter, even if the characteristic variation curves shown in FIG. 6 or FIG. 10 is not obtained, it is possible to carry out the characteristic adjustment by use of the characteristic adjustment look-up table of the first one piece of the display panel, and it is possible to reduce processing time of the characteristic adjustment process to display panels of the second one and thereafter.

Further, in this embodiment, as an emitter for evaluation use for preparing the look-up table, emitters of an image display area 301*a* in the display panel 301 are used. However, in this embodiment and the second embodiment which will be described later, dummy devices which are not driven on displaying images are disposed and data may be obtained by them.

Figure 4:
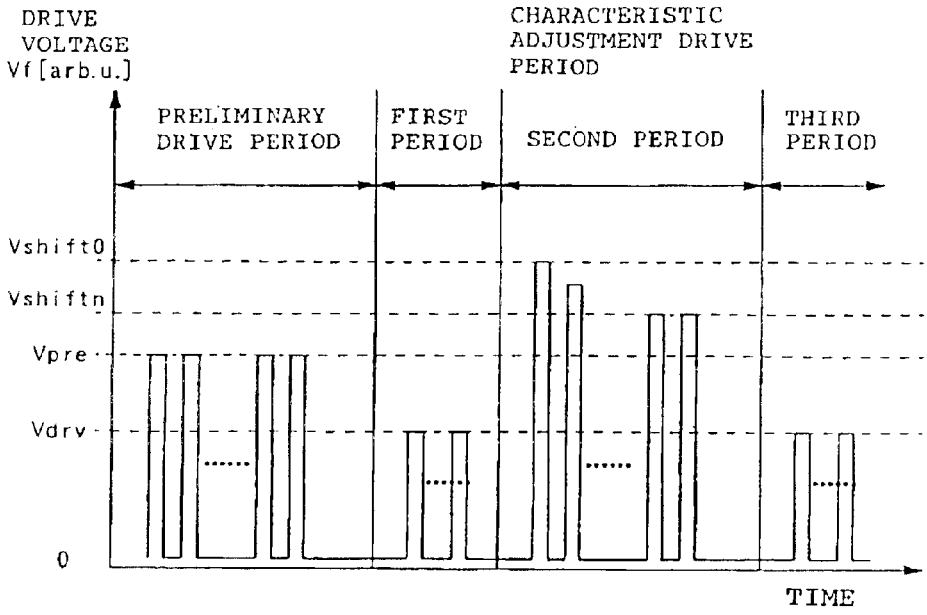
FIG. 4 is a view showing one example of the characteristic adjustment signal of the SCE-emitter relating to the first embodiment.

Also, in this embodiment, the characteristic shift voltages are set in two stages. However, as shown in FIG. 4, they may be set as voltages of three and more stages.

EXAMPLE 1

In this example, with regard to a display panel comprising 900×300 pieces of SCE-emitters, drive adjustment is carried out by use of a manufacturing method of this embodiment. Here, preparation of the look-up table and application of the characteristic shift voltage will be described. AS to others such as preparation of the display panel and soon, they are manufactured as described in the literatures 1 and 2.

Firstly, as described in the first embodiment, the luminance target value L0 is determined on the basis of the average luminance and the standard deviation.

In this example, the target luminance L0 is set at 9600 (a.u.). In addition, the value of the luminance is a value which corresponds to the luminance obtained from CCD.

Next, pulse width is set to 1 msec, and cycle is set to 10 msec, and others are set to satisfy Vpre=16V, Vdrv=14.5V, Vshift1=16.5V, Vshift2=17V, Vshift3=17.5V, Vshift4=18V, Vshift1'=16V, Vshift2'=16.5V, and Vshift3'=17V. And, as described in the first embodiment, the look-up table was prepared.

Figure 7:
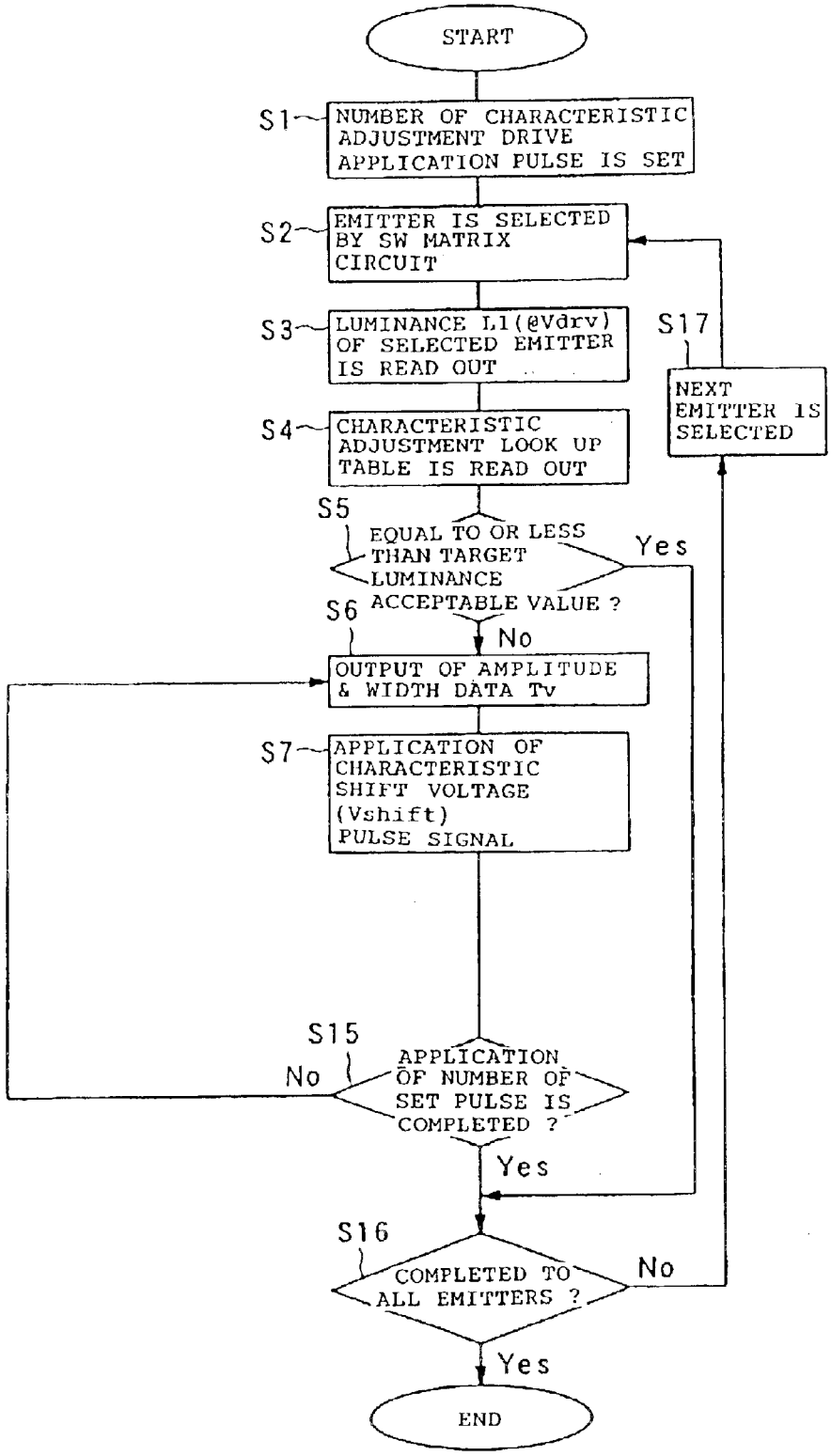
FIG. 7 is a characteristic adjustment flow chart of each SCE-emitter in the electron source of an example 1.

Hereinafter, procedures of characteristic adjustment method will be described by use of a flow chart of FIG. 7.

Firstly, at Step S1, set is the number of applied pulses which are applied at the time of characteristic adjustment to one of SCE-emitters to which the characteristic adjustment is carried out in the display panel 301. The number of applied pulses is set to 10 pulses.

Next, at Step S2, the switch matrix control signal Tsw is outputted, and the switch matrixes 303 and 304 are switched by the switch matrix control circuit 310, and one of the SCE-emitters is selected from the display panel 301.

At Step S3, as to the selected emitter, the luminance value L1 at the time of application of the normal drive voltage Vdrv after the preliminary drive is read out.

At Step S4, the characteristic adjustment look-up table is read out.

At Step S5, the luminance value L1 of the selected emitter which was read out at Step S3 is compared to the target value L0 in the characteristic adjustment, and it is judged whether or not the characteristic adjustment is carried out.

In case that the luminance value L1 of the selected emitter which was read out at Step S3 is equal to or less than the target value L0 in the characteristic adjustment, the characteristic adjustment is not carried out and it goes on to Step S16.

In case that the luminance value L1 of the selected emitter which was read out at Step S3 is larger than the target value L0 in the characteristic adjustment, any one of the characteristic shift voltage values Vshift1 to Vshift4 and Vshift' corresponding to the luminance values of the selected emitter referring to the characteristic adjustment look-up table which was read out at Step S4 is set to the memory 312*c*.

And, at Step S6, the data Tv of the amplitude of the pulse signal and the pulse width value which were set in the memory 312*c* for being applied to the selected emitter are outputted to the pulse amplitude setting circuit 311.

At Step S7, any one pulse signal of the characteristic shift voltage values Vshift1 to Vshift4 was applied to the SCE-emitter which was selected at Step S2, from the pulse generation circuits 306 and 307 through the switch matrixes 303 and 304.

Thereafter, it goes on to Step S15 of checking the number of cumulative pulse applications to the set number of pulses.

In case that the number of cumulative pulse applications has not yet reached the set value of the number of the characteristic adjustment drive applied pulses, in the same manner as in the pulse application at the previous time, it goes on to Step S6 for applying the pulses, and in case that it was reached, it goes on to Step S16.

At Step S16, it is investigated whether or not the characteristic adjustment was carried out to all of the SCE-emitters of the display panel 301, and if not, it goes on to Step S17 and a next SCE-emitter is selected, and the switch matrix control signal Tsw is outputted, and then, it goes on to Step S2.

At Step S16, when the procedure shown in the flow chart is finished for all of the emitters, the characteristic adjustment is completed, and the luminance of all emitters made uniform.

Thereafter, in order to evaluate the uniformity, the Vdrv voltage was applied and the luminance of all SCE-emitters was measured. As a result, the standard deviation/the luminance becomes 3.2%, and the uniformity with no problem for displaying moving images was obtained. Also, time which was required for adjusting the characteristic was one hour.

COMPARATIVE EXAMPLE 1

In the comparative example 1, as the characteristic shift voltage, one voltage value of which the target value is reached by ten pulses is set for each SCE-emitter having luminance characteristic, and the characteristic adjustment is carried out. As a result, apparently, there exists the emitter whose luminance was decreased, and it was impossible to secure sufficient uniformity upon displaying the moving images. The time which was required for the characteristic adjustment at this time was one hour.

EXAMPLE 2

As described above, there exist a small number of electron sources in which rates of changes to the number of applied pulses in the characteristic variation curves shown in FIG. 6 differ greatly. In this example, even as to such electron sources, by incorporating a way, described later, of coping with them into the steps (1) and (2) for adjusting the characteristic of large majority of the electron sources, it became possible to adjust the characteristic thereof.

Here, a method of setting characteristic shift voltages and a method of adjusting characteristics which are different from those of the example 1 will be described. As to other processes, similar techniques to the example 1 were used and therefore, descriptions thereof will be omitted. Also, SCE-emitters used and voltage setting were made to be the same as the example 1. Further, the luminance target value L0 is also set at 9600 (a.u).

As the electron source which did not reach the vicinity of the target luminance regardless of having executed the characteristic adjustment by the technique of the example 1, one is an electron source which did not reach the target luminance because the shift amount was small, and another is an electron source which fell short of the target luminance during the characteristic adjustment. That is, it means that they were the electron sources in which rates of changes to the characteristic variation curves shown in FIG. 6 differed greatly.

And, a method of reducing such electron sources with incomplete characteristic adjustment will be described hereinafter. Firstly, in order to estimate whether or not the electron source is such one whose characteristic adjustment is not to be completed, compared are the shift amount calculated from the luminance L1' which was measured by applying the normal drive voltage Vdrv after the first time characteristic shift voltage was applied and estimated shift amount. Assuming that the estimated shift amount is Dn, actual shift amount Dr becomes Dr=L1'/L1., from the initial luminance L1 and luminance L1' after the application of one pulse of the characteristic shift voltage Vshift A difference ΔD of the shift amounts is described as ΔD=Dn−Dr.

It has been found that the electron sources with different shift amounts have different shift amounts with substantially the same ratio to the shift voltage values. Then, a value of the shift amount to be targeted multiplied with Dn/Dr, D×Dn/Dr is estimated as shift amount correction value, and the characteristic shift voltage Vshift' is determined from FIG. 6C. Also, with regard to one which has already become less than the target luminance L0 at this point, the application of Vshift' is not carried out.

Hereinafter, a method of adjusting the characteristic will be described by use of a flow chart of FIG. 8.

Firstly, at Step S1, set is the number of applied pulses which are applied at the time of characteristic adjustment to each of SCE-emitters to which the characteristic adjustment is carried out in the display panel 301. The number of applied pulses is set to 10 pulses.

Next, at Step S2, the switch matrix control signal Tsw is outputted, and the switch matrixes 303 and 304 are switched by the switch matrix control circuit 310, and one of the SCE-emitters is selected from the display panel 301.

At Step S3, as to the selected emitter, the luminance value L1 at the time of application of the normal drive voltage Vdrv after the preliminary drive is read out.

At Step S4, the characteristic adjustment look-up table is read out.

At Step S5, the luminance value L1 of the selected emitter which was read out at Step S3 is compared to the target value L0 in the characteristic adjustment, and it is judged whether or not the characteristic adjustment is carried out.

In case that the luminance value L1 of the selected emitter which was read out at Step S3 is equal to or less than the target value L0 in the characteristic adjustment, the characteristic adjustment is not carried out and it goes on to Step S16.

In case that the luminance value L1 of the selected emitter which was read out at Step S3 is larger than the target value L0 in the characteristic adjustment, the pulse width 1 msec of any one of the characteristic shift voltage values Vshift1 to Vshift4 and Vshift' corresponding to the luminance values of the selected emitter referring to the characteristic adjustment look-up table which was read out at Step S4 is set to the memory 312*c*.

And, at Step S6, the data Tv of the amplitude of the pulse signal and the pulse width value which were set in the memory 312*c* for being applied to the selected emitter are outputted to the pulse amplitude setting circuit 311.

At Step S7, any one pulse signal of the characteristic shift values Vshift1 to Vshift4 was applied to the SCE-emitter which was selected at Step S2, from the pulse generation circuits 306 and 307 through the switch matrixes 303 and 304.

At Step S11, it is checked whether or not the pulse application was of the first time, and in case of the first time, it goes on to Step S8, and in case that the pulse application is of a second time and thereafter, it goes on to Step S15 of checking the number of cumulative pulse applications with respect to the set number of pulses.

At Step S8, in order to evaluate the characteristic of the emitter at the time when the emitter to which the characteristic adjustment was applied was driven by decreasing to the normal drive voltage Vdrv, as the data Tv of the amplitude of the pulse signal and the pulse width value which were set in the memory 312*c* for being applied to the selected emitter, the normal drive voltage value Vdrv and the pulse width 1 msec are set respectively.

And, at Step S9, the pulse voltage of the normal drive voltage value Vdrv is applied to the SCE-emitter which was selected at Step S2. The Luminance L1' at this time is measured and stored in the memory at Step S10.

At Step S12, in case that the luminance L1' which was measured at Step S10 does not become equal to or less than a target acceptable value L0 in the characteristic adjustment, it goes on to Step S13 for checking the first time shift amount. In case that the luminance L1' of the emitter which was measured at Step S10 is equal to or less than the luminance target value L0 in the characteristic adjustment, it goes on to Step S16 without carrying out the characteristic adjustment.

Also, at Step S13, in order to judge whether or not the selected emitters are the electron sources in which the characteristic shift amounts shown in FIG. 6 differ greatly, read out is the shift amount corresponding to the characteristic shift voltage which is applied to the selected emitters from the above-described memory 312*c*. And, as to the selected emitters, the luminance L1 at the time of application of the normal drive voltage Vdrv after the preliminary drive is compared to the luminance L1' which was measured at Step S10. Estimated shift amount and the actual shift amount are compared to each other, and it is judged whether or not the shift amount falls within the acceptable range.

If within the acceptable range, it goes on to Step S6, and preset Vshift' voltage is applied.

In case of outside of the acceptable range, it goes on to Step S14, and the shift amount correction value is set, and referring to the look-up table, determined is Vshift' voltage which conforms to the shift amount correction value, and it goes on to Step S6.

On the other hand, at Step S15, it is checked whether or not the number of cumulative pulse applications to the selected emitter with respect to the pulse application of the second time and thereafter has reached the set number of the characteristic adjustment drive application pulses. In case that it has not yet reached, it goes on to Step S6 for applying the pulses, in the same manner as in the pulse application at the previous time, and in case that it was reached, it goes on to Step S16.

At Step S16, it is investigated whether or not the characteristic adjustment was carried out to all of the SCE-emitters of the display panel 301, and if not, it goes on to Step S17 and a next SCE-emitter is selected, and the switch matrix control signal Tsw is outputted, and then, it goes on to Step S2.

At Step S16, when the procedure shown in the flow chart is finished for all of the emitters, the characteristic adjustment is completed, and the luminance of all emitters made uniform.

Thereafter, in order to evaluate the uniformity, the Vdrv voltage was applied and the luminance of all SCE-emitters was measured. As a result, the standard deviation/the luminance becomes 3.0%, and the uniformity with no problem for displaying moving images was obtained. Also, time which was required for adjusting the characteristic was about 1.3 hours.

EXAMPLE 3

In this example, correction of the characteristic voltage which was carried out in the example 2 was carried out with respect to each pulse. Here, a method of setting characteristic shift voltages and a method of adjusting characteristics which are different from those of the example 1 will be described. As to other processes, similar techniques to the example 1 were used and therefore, descriptions thereof will be omitted.

Compared are shift amount calculated from luminance Lp (before application) and Lp' (after application) at the time of applying Vdrv before and after the characteristic shift voltage pulse is applied and shift amount which was estimated. Assuming that the estimated shift amount is Dn, actual shift amount Dr becomes Dr=L1'/L1, from the luminance Lp before the application of one pulse of the characteristic shift voltage and luminance L1' after that.

A difference ΔD of the shift amounts is described as ΔD=Dn−Dr.

Thereby, it has been found that, in case of ΔD>0, the set voltage is required to be increased, and in case of ΔD<0, the set voltage is required to be decreased. Here, as to voltage setting after Vshift', in case of ΔD>0, the voltage is increased by 0.25 V, and in case of ΔD<0, the voltage is decreased by 0.25V. Also, the correction after the application of Vshift is carried out in the same manner as in the example 2 to determine the characteristic shift voltage.

Heretofore, a technique for determining the characteristic shift voltage is described. Hereinafter, the characteristic adjustment method will be described by use of a flow chart of FIG. 9.

Firstly, at Step S1, set is the number of applied pulses which are applied at the time of characteristic adjustment to one of the SCE-emitters to which the characteristic adjustment is applied in the display panel 301. The number of applied pulses is set to 10 pulses.

Next, at Step S2, the switch matrix control signal Tsw is outputted, and the switch matrixes 303 and 304 are switched by the switch matrix control circuit 310, and one of the SCE-emitters is selected from the display panel 301.

At Step S3, as to the selected emitter, the luminance value Lp at the time of application of the normal drive voltage Vdrv after the preliminary drive is read out.

At Step S4, the characteristic adjustment look-up table is read out.

At Step S5, the luminance value Lp of the selected emitter which was read out at Step S3 is compared to the target value L0 in the characteristic adjustment, and it is judged whether or not the characteristic adjustment is carried out.

In case that the luminance value Lp of the selected emitter which was read out at Step S3 is equal to or less than the target value L0 in the characteristic adjustment, the characteristic adjustment is not carried out and it goes on to Step S16.

In case that the luminance value Lp of the selected emitter which was read out at Step S3 is larger than the target value L0 in the characteristic adjustment, any one of the characteristic shift voltage values Vshift1 to Vshift4 and Vshift' corresponding to the luminance value of the selected emitter referring to the characteristic adjustment look-up table which was read out at Step S4 is set to the memory 312*c* with the pulse width 1 msec.

And, at Step S6, the data Tv of the amplitude of the pulse signal and the pulse width value which were set in the memory 312*c* for being applied to the selected emitter are outputted to the pulse amplitude setting circuit 311.

At Step S7, any one pulse signal of the characteristic shift values Vshift1 to Vshitf4 was applied to the SCE-emitter which was selected at Step S2, from the pulse generation circuits 306 and 307 through the switch matrixes 303 and 304.

Next, at Step S15, it is checked whether or not the number of cumulative pulse applications to the selected emitter for the pulse application has reached the set number of the characteristic adjustment drive application pulses, and in case that it has not yet been reached, it goes on to Step S8 and in case that it has been reached, it goes on to Step S16.

At Step S8, in order to evaluate the characteristic of the emitter at the time when the emitter to which the characteristic adjustment was carried out was driven by decreasing to the normal drive voltage Vdrv, as the data Tv of the amplitude of the pulse signal and the pulse width value which were set in advance in the memory 312*c* for being applied to the selected emitter, the normal drive voltage value Vdrv and the pulse width 1 msec are set respectively.

And, at Step S9, the pulse voltage of the normal drive voltage value Vdrv is applied to the SCE-emitter which was selected at Step S2. The Luminance Lp' at this time is measured at Step S10 and stored in the memory 312*c*.

At Step S12, in case that the luminance Lp' which was measured at Step S1 does not become equal to or less than a target acceptable value L0 in the characteristic adjustment, it goes on to Step S13 for checking the shift amount. In case that the luminance Lp' of the emitter which was measured at Step S10 is equal to or less than the target acceptable value L0 in the characteristic adjustment, it goes on to Step S16 without carrying out the characteristic adjustment.

Also, at Step S13, in order to judge whether or not the selected emitters are the electron sources in which the characteristic shift amounts shown in FIG. 6 differ greatly, read out is the shift amount corresponding to the characteristic shift voltage which is applied to the selected emitters from the above-described memory 312*c*. And, as to the selected emitters, the luminance Lp at the time of application of the one-time-before normal drive voltage Vdrv is compared to the luminance Lp' which was measured at Step S10. Estimated shift amount and the actual shift amount are compared to each other, and it is judged whether or not the shift amount falls within the acceptable range.

If within the acceptable range, it goes on to Step S6, and preset characteristic shift voltage is applied.

In case of out of the acceptable range, it goes on to Step S14, and the shift amount correction value is set, and referring to the look-up table, determined is the characteristic shift voltage which conforms to the shift amount correction value, and it goes on to Step S6.

On the other hand, at Step S16, it is investigated whether or not the characteristic adjustment was carried out to all of the SCE-emitters of the display panel 301, and if not, it goes on to Step S17 and a next SCE-emitter is selected, and-the switch matrix control signal Tsw is outputted, and then, it goes on to Step S2.

At Step S16, when the procedure shown in the flow chart is finished for all of the emitters, the characteristic adjustment is completed, and the luminance of all emitters is made uniform.

Thereafter, in order to evaluate the uniformity, the Vdrv voltage was applied and the luminance of all SCE-emitters was measured. As a result, the standard deviation/the luminance becomes 3.0%, and the uniformity with no problem for displaying moving images was obtained. Also, time which was required for adjusting the characteristic was about 2.5 hours.

(Second Embodiment)

Figure 10B:
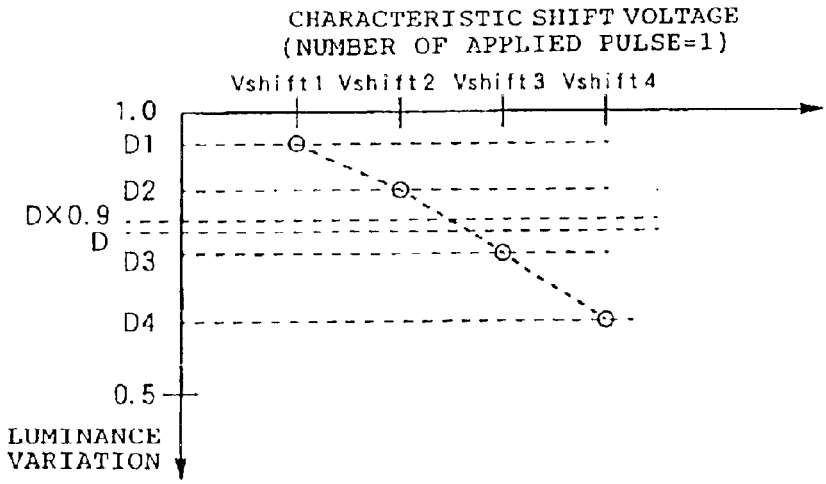
Figure 11:
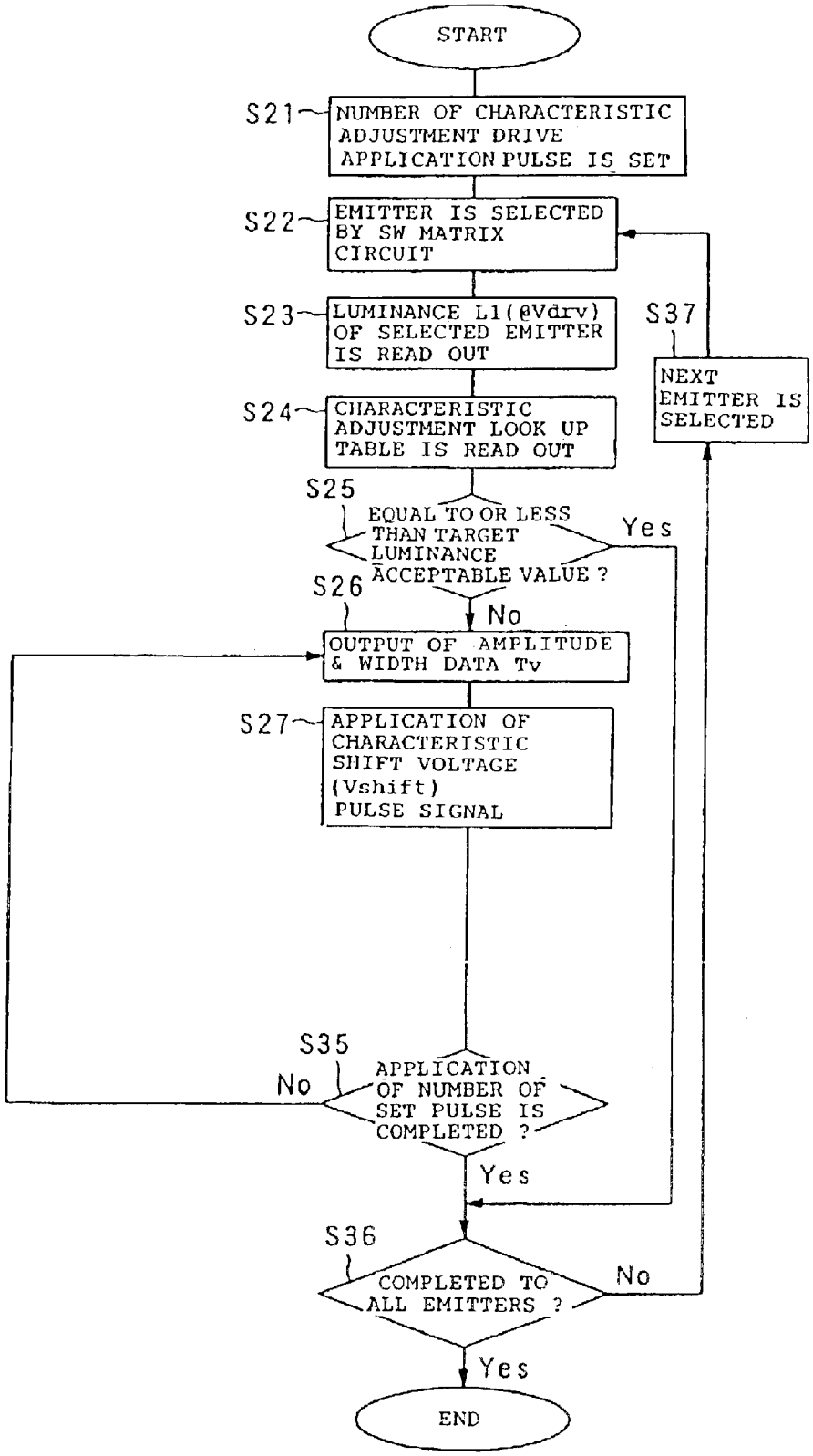
FIG. 11 is a characteristic adjustment flow chart of each SCE-emitter in the electron source of an example 4.
Figure 12:
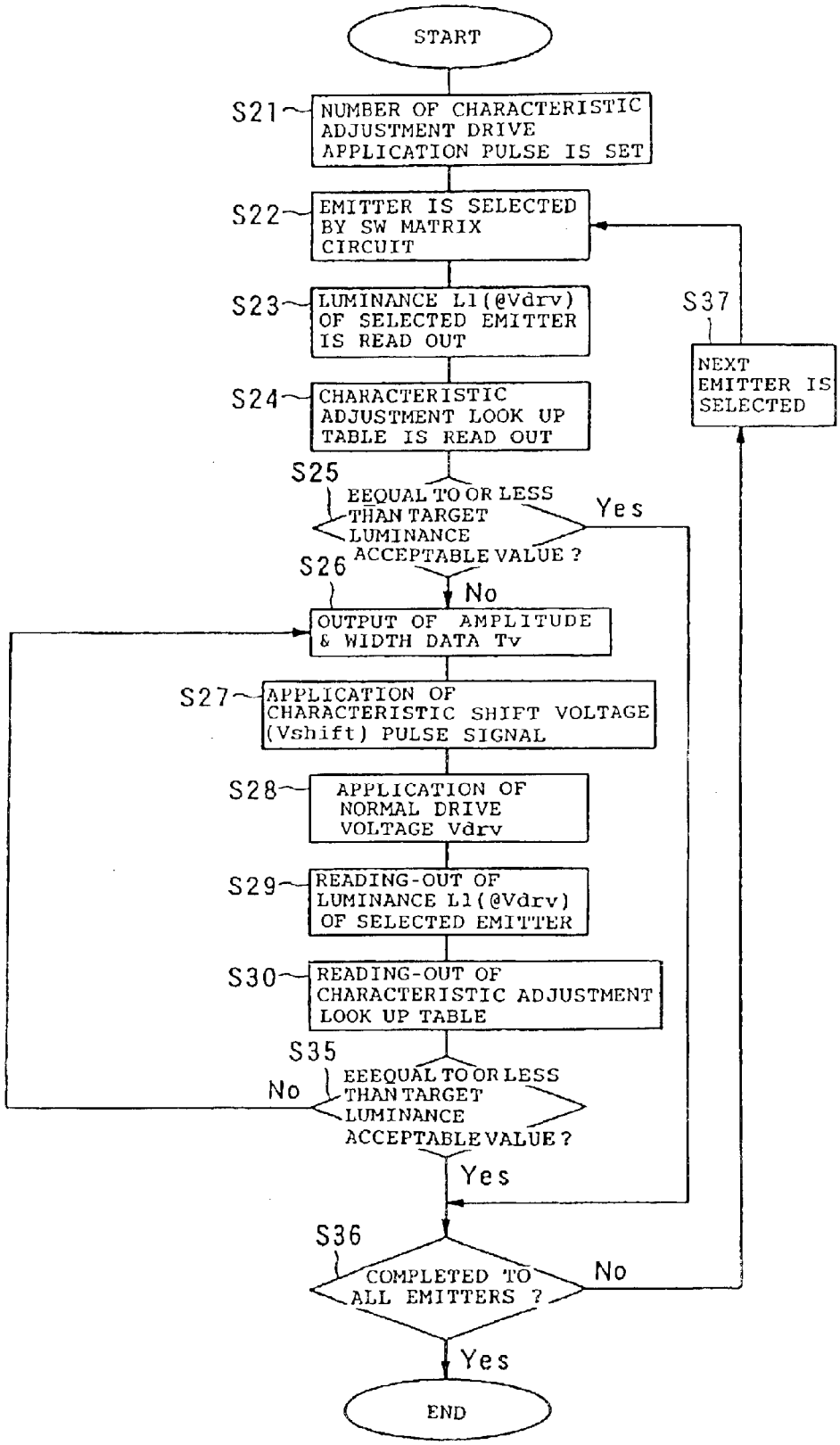
FIG. 12 is a characteristic adjustment flow chart of each SCE-emitter in the electron source of an example 5.

FIGS. 10 to 12 show a second embodiment. In the above-described first embodiment, during the second period of the characteristic adjustment period, application voltage of the pulse of Vshift was increased and decreased. However, in this embodiment, during the second period of the characteristic adjustment period, application time of the pulse of Vshift is increased and decreased.

Since other structures and operations are the same as in the first embodiment, the same characters are used for the same structural portions and descriptions thereof will be omitted.

Assuming that the pulse width of the characteristic shift voltage Vshift is Tshift, when the pulse width is shortened at the same Vshift, the applied pulses are increased so that the pulse application time becomes elongated, and when the pulse width is elongated, a ratio of change of the characteristic by the first pulse is enlarged, and there exists the emitter whose light-emission characteristic value becomes less than a desired light-emission characteristic target value.

Accordingly, by changing the first pulse width Tshift1 at the characteristic shift voltage pulse and the pulse widths Tshift2 to Tshiftm at the second pulse and thereafter, a luminance value is shifted to the vicinity of the target value L0 for a short period of time, and after that, in the course of shifting to L0, a margin is produced to time, and a margin to variation of the change of the shift amount is increased. By use of this characteristic change, application time of the pulse of Vshift to the emitter is increased and decreased during the second period, and it is possible to set the luminance at the normal drive voltage Vdrv during the third period to a specific value.

A method of setting the luminance target value, since it is the same as in the first embodiment, will be omitted to be described.

A procedure for measuring the luminance when a plurality of characteristic shift voltage is applied (1 to 1000 pulses) to a plurality of SCE-emitters in the place 301*a* which hardly produce any troubles upon displaying images on the display panel 301 and a stage of obtaining data of relation of the characteristic shift voltage and the shift amount for preparing the look-up table for adjusting the characteristic from the data will be described.

At the beginning, it is properly determined the pulse width of the characteristic shift voltage, the amplitude of the characteristic shift voltage, and how many pulses of different several amplitudes are applied to individual emitters with regard to. Here, a case that, as the characteristic shift voltage, different two amplitudes are applied with one pulse and nine pulses respectively, and that the characteristic is adjusted with ten pulses in total will be described as one example.

On the occasion of obtaining data for preparing the look-up table, firstly, as the characteristic shift voltage, discrete voltage values of four steps (Vshift1 to Vshift4) are selected and the characteristic shift amount is observed with respect to each voltage.

Thereafter, by applying characteristic shift voltage Vshift' which is different from respective characteristic shift voltages, the characteristic shift amount after that was observed.

Here, range of the characteristic shift voltage is, as described above, of Vshift≧Vpre, and range of Vshift voltage is properly set depending upon shapes and materials of the SCE-emitter but, normally, the characteristic can be adjusted by setting it with several steps having step width of about 1V.

Also, a case that, as the characteristic shift voltage, small pulse width Vshift of four steps and Vshift' having longer pulse width as compared to Vshift will be described. However, there is no problem if both of Vshift and Vshift' comprise a plurality of steps.

A procedure will be described for measuring change amount of the luminance when four characteristic shift voltages with small pulse widths Vshift1, Vshift2, Vshift3 and Vshift4 are applied to a plurality of the SCE-emitters, respectively, and thereafter, the characteristic shift voltage Vshift' of a pulse width different from that of respective characteristic shift voltages is applied.

Firstly, set are an area in which each of the four characteristic shift voltages are applied to the plurality of the SCE-emitters, the number of the emitters, respective characteristic shift voltage values, pulse width values and the number of pulses applied.

As an area in the display panel 301 in which each of 4×1 characteristic shift voltages is applied to the plurality of the SCE-emitters, the place 301*a* which hardly gives no trouble upon displaying images is selected, and the number of the emitters is set to twenty-one (21) emitters to one characteristic shift voltage.

The switch matrix control signal Tsw is outputted and the switch matrixes 303 and 304 are switched by the switch matrix control circuit 310, and thereby, one of the SCE-emitters is selected in the display panel 301.

The data Tv of the pulse signal which is applied to the selected emitter and set in advance is outputted to the pulse amplitude setting circuit 311. The amplitude of the pulse for the characteristic shift voltage is a amplitude of the preliminary drive voltage value Vpre, any one of the characteristic shift voltage values Vshift1, Vshift2, Vshift3, and Vshift4, or Vshift' which has longer pulse width than Vshift, and the number of pulses is properly set to be one and more.

To the selected SCE-emitters, from the pulse generation circuits 306 and 307 through the switch matrixes 303 and 304, the pulse signal of the preliminary drive voltage value Vpre is applied as a first time application of the characteristic shift voltage.

Next, in order to evaluate the luminance characteristic at the time when the emitter to which the characteristic shift voltage was applied was driven by decreasing to the normal drive voltage Vdrv, set is the data Tv of the pulse signal which is applied to the selected emitter and set in advance.

And, to the selected SCE-emitter, the pulse signal of the normal drive voltage value Vdrv is applied. The luminance at Vdrv voltage is stored in the luminance data storage memory 312*b* as variation data of the electron emission amount in response to the application of the characteristic shift voltage.

It is investigated whether the characteristic shift voltage was applied with predetermined number of times to the selected SCE-emitter, and if not, it goes on to the step for applying the characteristic shift voltage. On one hand, when the characteristic shift voltage reached the predetermined number of times for application, it is investigated whether or not variation of the luminance value is measured for a plurality of predetermined SCE-emitters, and if not, set is the switch matrix control signal Tsw for selecting next SCE-emitter.

On the other hand, when measurement processing to the predetermined SCE-emitters has been completed, variation of the luminance when each of the four characteristic shift voltages Vshift1, Vshift2, Vshift3 and Vshift4 was applied (one pulse) to the plurality of the predetermined SCE-emitters, and variation of the luminance by the characteristic shift voltage Vshift' applied after that are plotted to prepare a graph.

FIG. 10 shows relation of variation of the luminance after each of the four characteristic shift voltages Vshift1, Vshift2, Vshift3 and Vshift4 was applied to the plurality of the SCE-emitters and variation (average value) of the luminance when Vshift' was applied after the application of the four characteristic shift voltages (Vshift1, Vshift2, Vshift3 and Vshift4). In addition, the luminances at this time are values which were measured when the emitters were normally driven with Vdrv with respect to each application of one pulse of characteristic shift voltage.

Next, a process for adjusting the characteristic of the entire multiple electron source will be described. As shown in FIG. 10, variation of the characteristic of the emitter is enlarged by increasing the number of the characteristic shift voltage application pulses or by enlarging the characteristic shift voltage. That is, adjustment amount is enlarged. The characteristic adjustment of the entire multiple electron source by use of the characteristic variation curves shown in FIG. 10 is carried out by the following two steps.

(3) The characteristic shift voltage is set on the basis of the target luminance L0 which was set from the luminance measurement result. That is, this step is the stage for preparing the look-up table for the characteristic adjustment.

(4) On the basis of the set value which was determined in (3), the characteristic shift voltage is set with respect to each emitter. And, by applying the characteristic shift voltage, the characteristic is shifted to the target value. That is, the characteristic shift voltage is applied in response to the look-up table for the characteristic adjustment.

The steps (3) and (4) will be described in detail.

(3) When the luminance L1 which was measured after the preliminary drive is tried to be reached the target value L0, necessary shift amount is D=L0/L1.

Thereafter, slightly small value to the necessary shift amount, here, the shift amount of 0.9×D is set. Here, since the shift amount is set to 90%, even if the ratio of change to the applied pulse differs by about 10%, the luminance does not become less than the target value. This value is properly set from variation of the change ratio.

On the basis of the graph of FIG. 10B, Vshift voltage is determined from the shift amount of 0.9×D.

By determining Vshift voltage from a range of the shift amount calculated as follows, it is possible to prevent the luminance of the SCE-emitter from becoming less than the target value by initial one pulse.

That is, Vshift1 corresponds to a range of D1≦0.9×D<D2, Vshift2 corresponds to a range of D2≦0.9×D<D3, Vshift3 corresponds to a range of D3≦0.9×D<D4, and Vshift4 corresponds to a range of D4≦0.9×D.

They are so determined respectively.

Next, on the basis of the graph of FIG. 10B, the characteristic shift voltage Vshift' having longer pulse width than the pulse width of Vshift voltage which was determined by the shift amount of 0.9×D is applied to the emitter and the shift amount is measured. That is, on pulse with Tshift of shorter pulse width and nine pulses with Tshift' of longer pulse width are to be applied to it.

Thus, the look-up table for adjusting the characteristic of the initial luminance L1 is prepared.

(4) Referring to the look-up table, by applying the characteristic shift voltage to individual emitters in response to each characteristic of the emitters, drive adjustment is carried out.

By doing as described above, it is possible to avoid excessive characteristic shift due to the initial application pulse (one pulse) in the emitter whose characteristic shift amount is large with respect to the characteristic shift voltage.

Accordingly, without any excessive characteristic shift to the plurality of the emitters in the multiple electron source, it is possible to realize more uniform characteristic shift.

Also, here, described was the case in which measurement of the actual shift amount is carried out at the first time. However, the invention is not limited to this, and there is no problem to carry out the process for correcting on the basis of the actual shift amount whenever the characteristic shift voltage is applied by any times.

EXAMPLE 4

In this example, with regard to a display panel comprising 900×300 pieces of SCE-emitters, drive adjustment is carried out by use of a manufacturing method of this embodiment. Here, preparation of the look-up table and application of the characteristic shift voltage will be described. AS to others such as preparation of the display panel and soon, they are manufactured as described in the literatures 1 and 2.

Firstly, as described above, the luminance target value L0 is determined on the basis of the average luminance and the standard deviation.

In this example, the target luminance became L0=9600 (a.u.). In addition, the value of the luminance is a value which corresponds to the luminance obtained from CCD.

Next, pulse width Tshift of the first characteristic shift voltage pulse at Vshift1 to Vshift4 is set to 500 μsec, and a pulse cycle is set to 10 msec, and voltage amplitudes of the respective characteristic shift voltages Vshift1 to Vshift4 are set to Vshift1=16.5V, Vshift2=17V, Vshift3=17.5V, and Vshift4=18V, and others are set to satisfy Vpre=16V, Vdrv=14.5V. Also, the pulse width Tshift' of the second and thereafter characteristic shift voltage pulse is set to Vshift'=1 msec. In addition, the voltage amplitude of Vshift' which is applied to the individual emitters is set to be the same value as the each voltage amplitude of the characteristic shift voltages Vshift1 to Vshift4 which were determined to the respective emitters, and only the pulse width thereof is to be changed. And, as described in the second embodiment, the look-up table was prepared.

Hereinafter, procedures of the characteristic adjustment method will be described by use of a flow chart of FIG. 11.

Firstly, at Step S21, set is the number of applied pulses which are applied at the time of characteristic adjustment to one of SCE-emitters to which the characteristic adjustment is carried out in the display panel 301. The number of applied pulses at Vshift is set to one pulse, and the number of the applied pulses at Vshift' is set to nine pulses, and the total number of the applied pulses are set to ten pulses.

Next, at Step S22, the switch matrix control signal Tsw is outputted, and the switch matrixes 303 and 304 are switched by the switch matrix control circuit 310, and one of the SCE-emitters is selected in the display panel 301.

At Step S23, as to the selected emitter, the luminance value L1 at the time of application of the normal drive voltage Vdrv after the preliminary drive is read out.

At Step S24, the characteristic adjustment look-up table is read out.

At Step S25, the luminance value L1 of the selected emitter which was read out at Step S23 is compared to the target value L0 in the characteristic adjustment, and it is judged whether or not the characteristic adjustment is carried out.

In case that the luminance value L1 of the selected emitter which was read out at Step S23 is equal to or less than the target value L0 in the characteristic adjustment, the characteristic adjustment is not carried out and it goes on to Step S36.

In case that the luminance value L1 of the selected emitter which was read out at Step S23 is larger than the target value L0 in the characteristic adjustment, referring to the characteristic adjustment look-up table which was read out at Step S24, any one of the characteristic shift voltage values corresponding to the luminance value of the selected emitter, Vshift1 to Vshift4 and Vshift' which is of the same voltage as respective shift voltages of Vshift1 to Vshift4 are set to the memory 312*c*.

And, at Step S26, the data Tv of the amplitude of the pulse signal and the pulse width value which were set in the memory 312*c* for being applied to the selected emitter are outputted to the pulse amplitude setting circuit 311.

At Step S27, any one pulse signal of the characteristic shift values Vshit1 to Vshit4 was applied to the SCE-emitter which was selected at Step S22, from the pulse generation circuits 306 and 307 through the switch matrixes 303 and 304. Further, applied was the pulse signal of Vshift' which is of the same voltage as the respective shift voltages of Vshift1 to Vshift4 and in which only the pulse width was changed.

Thereafter, it goes on to Step S35 of checking the number of cumulative pulse applications with respect to the set number of pulses.

In case that the number of cumulative pulse applications has not yet been reached the set value of the number of the characteristic adjustment drive applied pulses, in the same manner as in the pulse application at the previous time, it goes on to Step S26 for applying the pulses, and in case that it has been reached, it goes on to Step S36.

At Step S36, it is investigated whether or not the characteristic adjustment was carried out to all of the SCE-emitters of the display panel 301, and if not, it goes on to Step S37 and a next SCE-emitter is selected, and the switch matrix control signal Tsw is outputted, and then, it goes on to Step S22.

At Step S36, when the procedure shown in the flow chart is finished for all of the emitters, the characteristic adjustment is completed, and the luminance of all emitters made uniform.

Thereafter, in order to evaluate the uniformity, the Vdrv voltage was applied and the luminance of all SCE-emitters was measured. As a result, the standard deviation/the luminance becomes 3.2%, and the uniformity with no problem for displaying moving images was obtained. Also, time which was required for adjusting the characteristic was one hour.

COMPARATIVE EXAMPLE 2

In the comparative example 2, as the characteristic shift voltage, one voltage value with fixed pulse width of 1 msec which reaches the target value by ten pulses is set for each SCE-emitter having luminance characteristic, and the characteristic adjustment is carried out. As a result, a ratio of the emitter whose luminance becomes less than the target value by application of the first pulse at the characteristic shift voltage became 23% to the entirety, and the luminance variation of the entire multiple electron sources was increased, and therefore, it was impossible to secure sufficient uniformity upon displaying moving images. The time which was required for the characteristic adjustment at this time was one hour.

EXAMPLE 5

Next, an example 5 will be described. In this example, measured will be the luminance of the SCE-emitter in which the characteristic shift was carried out by applying Vdrv voltage with respect to each pulse application of the characteristic shift voltage which was carried out in the example 4. According to a difference with the standard target value which was thereby obtained, it is determined whether or not the remaining number of pulses to be applied is applied.

Here, a setting method of the characteristic shift voltage and a characteristic adjustment method which are different from the example 4 will be described. Since other portions were carried out by the same technique as in the example 4, descriptions thereof will be omitted.

Hereinafter, procedures of characteristic adjustment method will be described by use of a flow chart of FIG. 12.

Firstly, at Step S21, set is the number of applied pulses which are applied at the time of characteristic adjustment to one of SCE-emitters to which the characteristic adjustment is carried out in the display panel 301. The number of applied pulses at Vshift is set to one pulse, and the number of the applied pulses at Vshift' is set to nine pulses, and the total number of the applied pulses are set to ten pulses.

Next, at Step S22, the switch matrix control signal Tsw is outputted, and the switch matrixes 303 and 304 are switched by the switch matrix control circuit 310, and one of the SCE-emitters is selected from the display panel 301.

At Step S23, as to the selected emitter, the luminance value L1 at the time of application of the normal drive voltage Vdrv after the preliminary drive is read out.

At Step S24, the characteristic adjustment look-up table is read out.

At Step S25, the luminance value L1 of the selected emitter which was read out at Step S23 is compared to the target value L0 in the characteristic adjustment, and it is judged whether or not the characteristic adjustment is carried out.

In case that the luminance value L1 of the selected emitter which was read out at Step S23 is equal to or less than the target value L0 in the characteristic adjustment, the characteristic adjustment is not carried out and it goes on to Step S36.

In case that the luminance value L1 of the selected emitter which was read out at Step S23 is larger than the target value L0 in the characteristic adjustment, referring to the characteristic adjustment look-up table which was read out at Step S24, any one pulse signal of the characteristic shift voltage values Vshift1 to Vshift4 corresponding to the luminance value of the selected emitter, is set to the memory 312*c*.

And, at Step S26, the data Tv of the amplitude of the pulse signal and the pulse width value which were set in the memory 312*c* for being applied to the selected emitter are outputted to the pulse amplitude setting circuit 311.

At Step S27, any one pulse signal of the characteristic shift values Vshit1 to Vshit4 was applied to the SCE-emitter which was selected at Step S22, from the pulse generation circuits 306 and 307 through the switch matrixes 303 and 304. Further, applied was only one pulse of the pulse signal of Vshift' which is of the same voltage as the respective shift voltages of Vshift1 to Vshift4 and in which only the pulse width was changed.

At Step S28, as to the selected emitter, the normal drive voltage Vdrv after the preliminary drive is applied.

At Step S29, as to the selected emitter, read out is the luminance value L1 at the time of applying the normal drive voltage Vdrv after Step S28.

At Step S30, the characteristic adjustment look-up table is read out.

Thereafter, at Step S35, the luminance value L1 of the selected emitter which was read out at Step S29 is compared to the target value L0, and it is judged whether or not the characteristic adjustment is carried out.

In case that the luminance value L1 of the selected emitter which was read out at Step S29 is equal to or less than the target value L0 in the characteristic adjustment, without applying pulses in the remaining pulse signals of Vshift', it goes on to Step S36.

In case that the luminance value L1 of the selected emitter which was read out at Step S29 is larger than the target value L0 in the characteristic adjustment, referring to the characteristic adjustment look-up table which was read out at Step S30, any one pulse signal of the characteristic shift voltages Vshift1 to Vshift4 corresponding to the luminance value of the selected emitter was set in the memory 312*c*. Further, it goes on to Step S26. And, it goes on from Step S26 to Step S27, and only one pulse of the pulses in the remaining pulse signals of Vshift' is applied, and from Step S28 through Step S30, again, the comparison of the luminance value L1 and the target value L0 at Step S35 is carried out.

In this manner, with respect to each applying only one pulse of the pulses in the pulse signals of Vshift', the comparison of the luminance value L1 and the target value L0 at Step S35 is carried out and the luminance L1 of the emitter to which the respective characteristic shift voltage was applied is compared to the target value L0, and thereby, it is determined whether or not the pulse width Tshift' in the remaining pulse signal of Vshift' is changed.

And, at Step S36, it is investigated whether or not the characteristic adjustment was carried out to all of the SCE-emitters of the display panel 301, and if not, it goes on to Step S37 and a next SCE-emitter is selected, and the switch matrix control signal Tsw is outputted, and then, it goes on to Step S22.

At Step S36, when the procedure shown in the flow chart is finished for all of the emitters, the characteristic adjustment is completed, and the luminance of all emitters is uniformized.

Thereafter, in order to evaluate the uniformity, the Vdrv voltage was applied and the luminance of all SCE-emitters was measured. As a result, the standard deviation/the luminance becomes 3.0%, and the uniformity with no problem for displaying moving images was obtained. Also, time which was required for adjusting the characteristic was one hour.

(Third Embodiment)

FIGS. 13 to 20 show a third embodiment. In the above-described first and second embodiments, during the second period of the characteristic adjustment period, application voltage of the pulse of Vshift was increased and decreased, and the application time of the pulse of Vshift was increased and decreased. However, in this embodiment, by determining maximum adjustment shift voltage for adjusting the emitter, selecting discretely the adjustment shift voltage value to be applied with several stages, and applying the same, the characteristic adjustment will be carried out.

Since other structures and operations are the same as in the first embodiment, the same characters are used for the same structural portions and descriptions thereof will be omitted.

FIG. 13 is a graph showing voltage wave forms of the preliminary drive and characteristic shift voltage signals which were applied to one SCE-emitter, focusing attention on one of the SCE-emitters constituting the multiple electron source, and a horizontal axis represents time and a vertical axis represents the voltage which was applied to the SCE-emitter (hereinafter, represented by emitter voltage Vf).

Figure 13A:
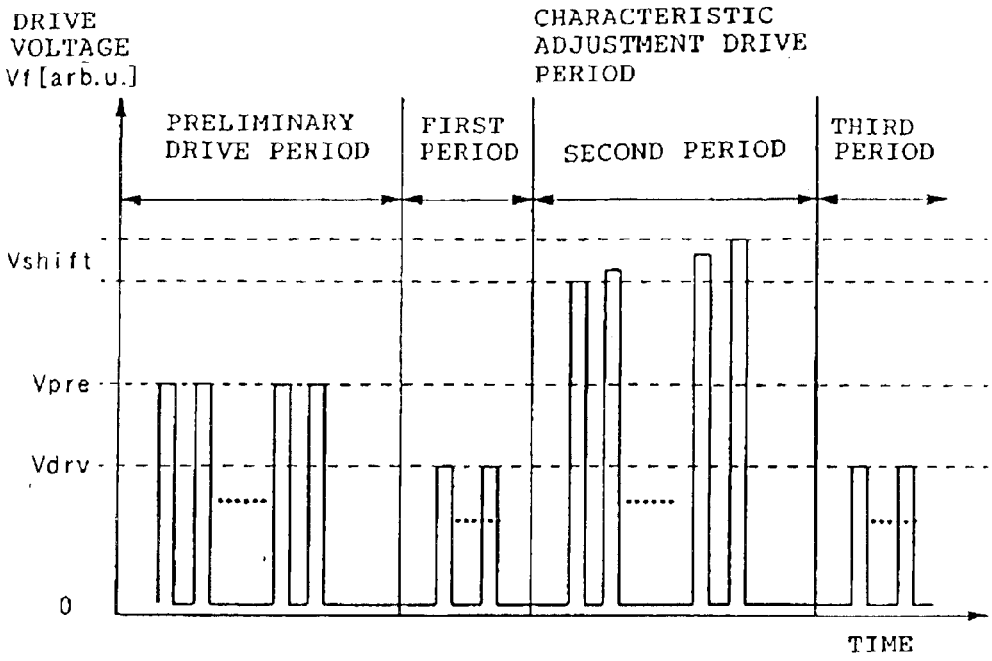
FIGS. 13A and 13B show one example of the characteristic adjustment signal of the SCE-emitter relating to a third embodiment.

Here, as the drive signal, a continuous rectangular voltage pulse as shown in FIG. 13A is used, and a period of applying a voltage pulse of the characteristic adjustment period is divided into three of a first period to a third period, and in each period, 1 to 10 pulses are applied. Depending upon the emitter, the amplitude of the applied pulse differs.

Figure 13B:
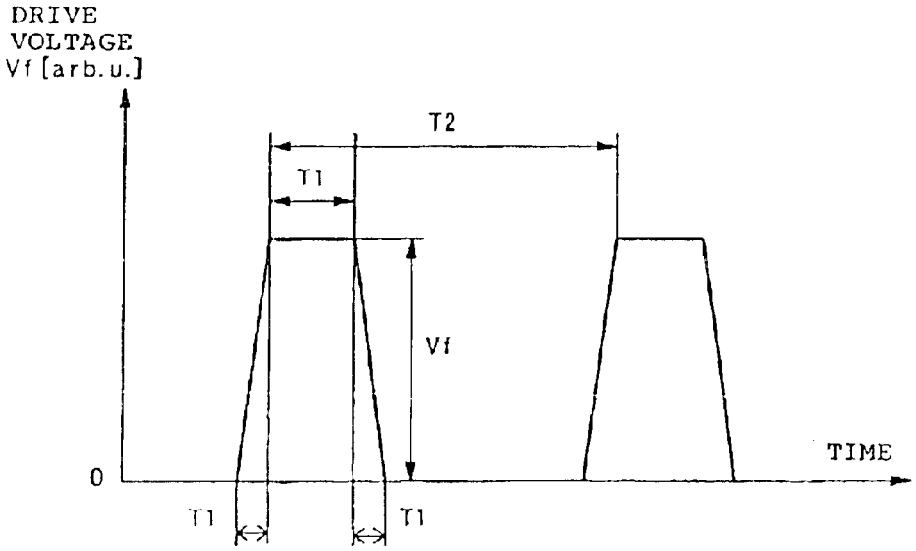

FIG. 13B shows in an enlarged manner a part of the voltage pulse wave forms of FIG. 13A.

As concrete drive conditions, the pulse width of the drive signal is set to be of T1=1 msec, and a pulse cycle is set to be of T2=10 msec.

In addition, in order that rising time Tr and falling time Tf of the voltage pulse which is effectively applied to the SCE-emitter become equal to or less than 100 ns, the emitter is driven by sufficiently reducing impedance of wiring paths from the drive signal source to the SCE-emitter.

Here, the emitter voltage Vf is set to be of Vr=Vpre during the preliminary drive peirod, and to be of Vf=Vdrv in the first and third periods of the characteristic adjustment period, and to be of Vf=Vshift in the second period.

These emitter voltages Vpre, Vdrv, and Vshift are all voltages which are larger than the electron emission threshold voltage of the SCE-emitter, and are set to satisfy a condition of Vdrv<Vpre≦Vshift.

In FIG. 13A, details of respective periods of the characteristic adjustment period will be described.

Since the first and third periods are the same as those of the above-described first embodiment, descriptions thereof will be omitted.

(Second Period Characteristic Shift Voltage Application Period)

In the second period, for the method of adjusting the characteristic of the luminance characteristic, by use of a memory function of the electron emission characteristic, the voltage value Vs of larger than the preliminary drive voltage Vpre is applied so that the luminance of emitting light from the fluorescent materials due to irradiation of electron beams is shifted.

Accordingly, the second period and the third period are not applied to the emitter which is not necessary for adjusting the characteristic.

In the second period, in order to be able to make adjustment within a predetermined time, 10 shots are applied to all of the emitters, and as to the amplitude for shifting the luminance characteristic, to the emitter which requires for a maximum adjustment rate, maximum adjustment shift voltage Vsmax is applied, and to other emitters which require for a lower adjustment rate than that, adjustment shift voltages (Vs1 to Vsmax−1) are properly set.

After the above-described respective drives are carried out to one emitter, the same process is applied to all of the emitters, and thereby, the characteristic adjustment processes to the multiple electron sources are completed.

Figure 14:
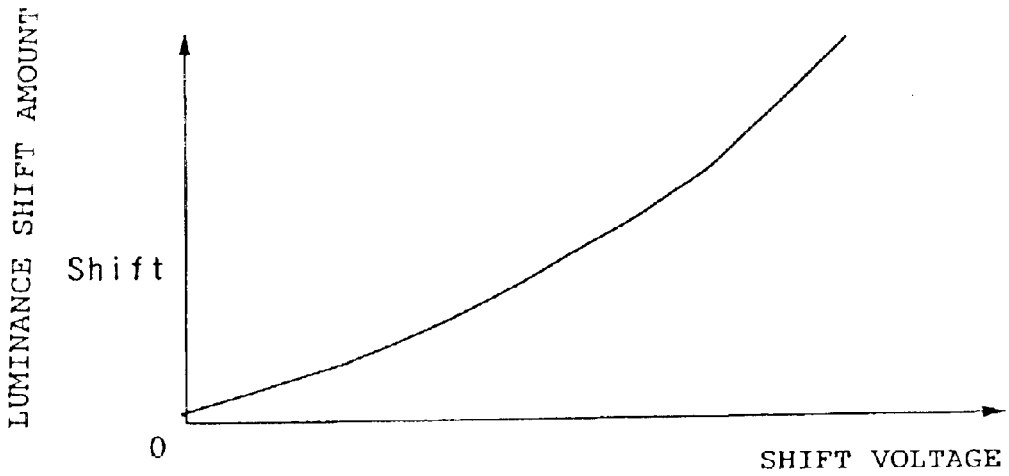
FIG. 14 is a graph showing a relation of shift voltage value and luminance sift amount.

In case that the characteristic adjustment is carried out by the same pulse, there is correlation of the shift amounts of the characteristic according to a difference of the shift voltage values which are applied at the time of adjusting the characteristic. FIG. 14 is a graph showing schematically correlation of the characteristic shift amount Shift and the shift voltage value when the characteristic shift voltage Vshift of magnitude of equal to or more than Vdrv was applied. An X axis of the graph represents shift voltage value, and a Y axis represents the luminance characteristic shift amount Shift. As shown in FIG. 14, the shift amount of the luminance characteristic is increased to the shift voltage value.

Figure 15:
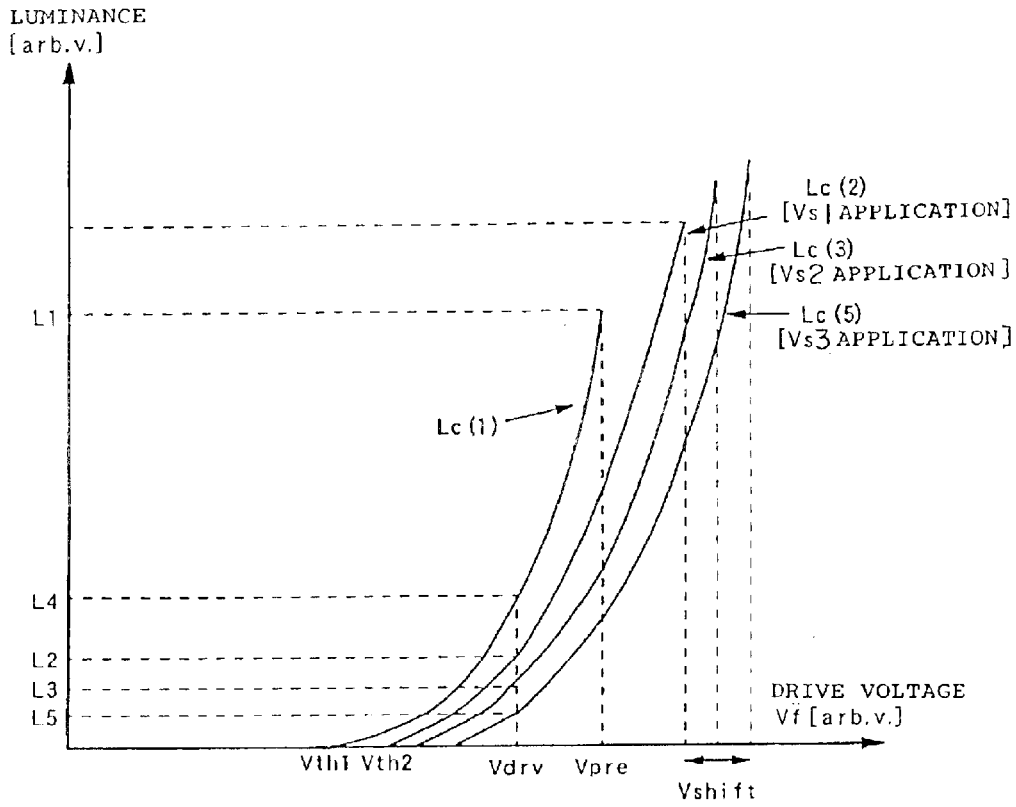
FIG. 15 is a view illustrating a luminance characteristic to drive voltage of the SCE-emitter.

FIG. 15 shows the relation of FIG. 14 seen from another aspect, and shows a fact that, in the second period, as the voltage value of Vf=Vshift is heightened, the light-emission luminance characteristic is shifted in the right direction.

As shown in FIG. 15, the emitter which showed the characteristic of Lc(1) before application of the shift pulse is changed to a situation Lc(2) in which Vshift1 was applied. When Vshift2 was applied, the light-emission luminance characteristic curve becomes Lc(3), and when Vshift3 was applied, the light-emission luminance characteristic curve becomes Lc(5).

Also, the light-emission luminance curve Lc(2) at the time of application of the characteristic shift pulse indicates the light-emission luminance L2 at the normal drive voltage Vdrv, and Lc(3) indicates the light-emission luminance L3 at the normal drive voltage Vdrv.

When this characteristic change is used, by increasing and decreasing Vs voltage to the emitter in the second period and by changing to desired emission current characteristic curves, it is possible to set the light-emission luminance at the normal drive voltage Vdrv in the third period to a specific value.

Then, in this embodiment, the characteristic adjustment of the entire multiple electron source can be carried out by a process for measuring the luminance of each emitter at the time of application of the normal drive voltage Vdrv by the luminance measurement device 305 and the calculation device 308, and setting the luminance target value L0 from the luminance, before the characteristic adjustment, by a process for reading out the maximum luminance signal Lmax, and by a process for determining maximum adjustment shift voltage which is applied to the emitter for adjustment from the maximum adjustment rate of the luminance signal Dmax=L0/Lmax and from an adjustment rate table of the luminance in the group of the characteristic shift voltages which was obtained in advance for another emitter, and selecting discretely the adjustment shift voltage value to be applied with several stages and applying the same.

Figure 20:
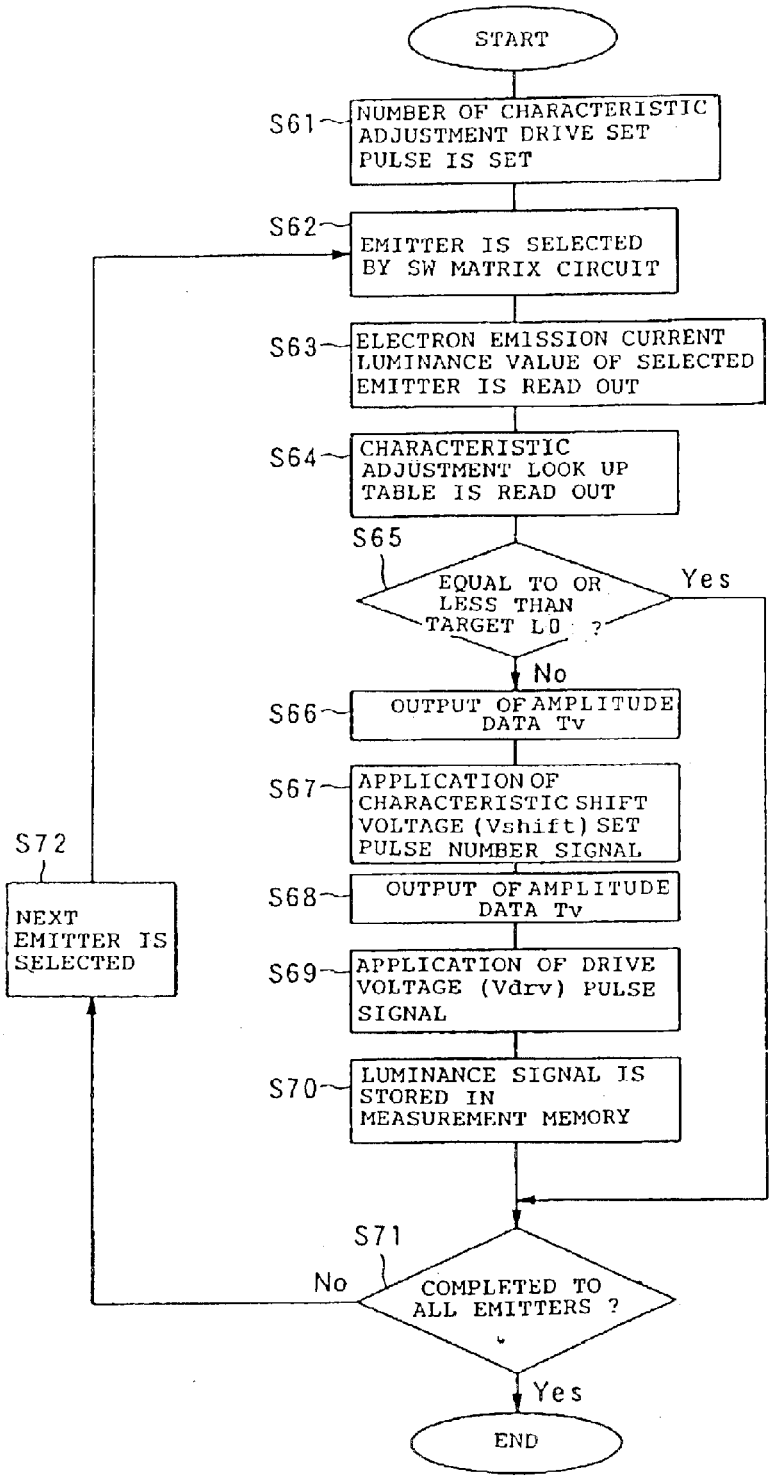
FIG. 20 is a characteristic adjustment flow following FIG. 17 of each SCE-emitter of the electron source.

A process flow for adjusting the luminance characteristic of the individual SCE-emitters constituting the multiple electron source will be described by use of flow charts of FIGS. 16, 17 and 20. In this embodiment, since the preliminary drive and the luminance characteristic adjustment drive are carried out integrally, description will be carried out including both drive processes.

The process flow comprises a first stage (corresponds to the flow chart of FIG. 17 and the second and third periods of the characteristic adjustment period of FIG. 13A) in which, by use of partial emitters of the image display area, emitters which are not used for image display and outside the image display area and further emitters of another image forming apparatus, on the basis of variation of the light-emission luminance at the time of applying a plurality of the different characteristic shift voltages Vshift which are larger than the drive voltage and the normal drive voltage Vdrv alternately, the look-up table is prepared, a second stage (corresponds to the flow chart of FIG. 16 and the preliminary drive period and the first period of the characteristic adjustment period of FIG. 13A) in which, after the preliminary drive voltage Vpre was applied to all SCE-emitters of the display panel 301, the luminance characteristic at the time of application of the normal drive voltage Vdrv is measured, and the luminance target value L0 at the time of adjusting the characteristic is set, and a third period (corresponds to the flow chart of FIG. 20 and the second and third periods of the characteristic adjustment period of FIG. 13A) having a process in which, in response to the look-up table for characteristic adjustment, by permissible luminance range ΔL from the maximum adjustment shift voltage Vsmax and the luminance target value, $n \geqq (Lmax-Lt)/\Delta L$ is calculated, and n pieces of discrete adjustment shift voltages which were calculated from each adjustment rate $Ds=1-((Dmax-1)m/n)[m=1 \ldots n-1]$ and are equal to or less than Vsmax are applied, and a process in which, in order to judge whether the characteristic adjustment was finished, the normal drive voltage Vdrv is applied and the light-emission luminance characteristic is measured.

Firstly, the first stage will be described.

On preparing the look-up table, as the group of the characteristic shift voltages, discrete voltage values of ten steps (Vshift1 to Vshift10) are selected and the characteristic shift amount is measured with respect to each voltage, respectively. A range of the characteristic shift voltage is, as described above, of Vshift≧Vpre, and a range of Vshift voltage is properly set depending upon shapes and materials of the SCE-emitters but, normally, the characteristic adjustment can be carried out by setting it, dividing into several steps of a range of about 1V.

Firstly, in the flowchart of FIG. 17 procedures for measuring variation of the luminance L when each of 11 kinds of the characteristic shift voltages Vshift0, Vshift1, Vshift2, Vshift3, Vshift4, . . . , Vshift10 was applied (10 pulses) to a plurality of the SCE-emitters will be described.

At Step S51, set are an area in which each of 11 kinds of the characteristic shift voltages is applied to a plurality of the SCE-emitters, the number of the emitters, respective characteristic shift voltages and the number of applied pulses. The number of the emitters is set to 100 emitters to one characteristic shift voltage.

At Step S52, the switch matrix control signal Tsw is outputted, and the switch matrixes 303 and 304 are switched by the switch matrix control circuit 310, and one of the SCE-emitters is selected from the display panel 301.

At Step S53, the data Tv of the amplitudes of the pulse signals which are applied to the selected emitters is outputted to the pulse amplitude setting circuit 311.

The amplitude of the pulse for the characteristic shift voltage is any one of the preliminary drive voltage value Vpre=16V, and the characteristic shift voltage values Vshift1=16.25V, Vshift2=16.5V, Vshift3=16.75V, Vshift4=17V . . . Vshift10=18.5V.

And, at Step S54, from the pulse generation circuits 306 and 307 through the switch matrixes 303 and 304, the pulse signal of the preliminary drive voltage value Vpre is applied as a first time of the characteristic shift voltage, to the SCE-emitters which are selected at Step S51.

At Step S55, in order to evaluate the luminance characteristic at the time when the emitter to which the characteristic shift voltage was applied was driven by decreasing to the normal drive voltage Vdrv, as the data TV of the amplitude of the pulse signal which is applied to the selected emitter, the normal drive voltage value Vdrv is set to be of Vdrv=14.5V.

And, at Step S56, the pulse signal of the normal drive voltage value Vdrv is applied to the SCE-emitters which are selected at Step S52.

At Step S57, as change data of the luminance in response to the characteristic shift, the luminance at Vdrv voltage is stored in the luminance data storage memory 312*b*.

At Step S58, it is checked whether or not measurement of change of the luminance is carried out to a plurality of given SCE-emitters, and if not, it goes on to Step S59, and the switch matrix control signal Tsw for selecting next SCE-emitter is set and it goes on to Step S52.

On the other hand, when measurement processing to the predetermined SCE-emitters has been completed at Step 58, variation of the luminance when each of 11 kinds of the characteristic shift voltages Vshift0 (=Vpre), Vshift1, Vshift2, Vshift3, Vshift4 . . . Vshift10 was applied (10 pulses) to the plurality of the predetermined SCE-emitters are plotted to prepare a graph.

Figure 18:
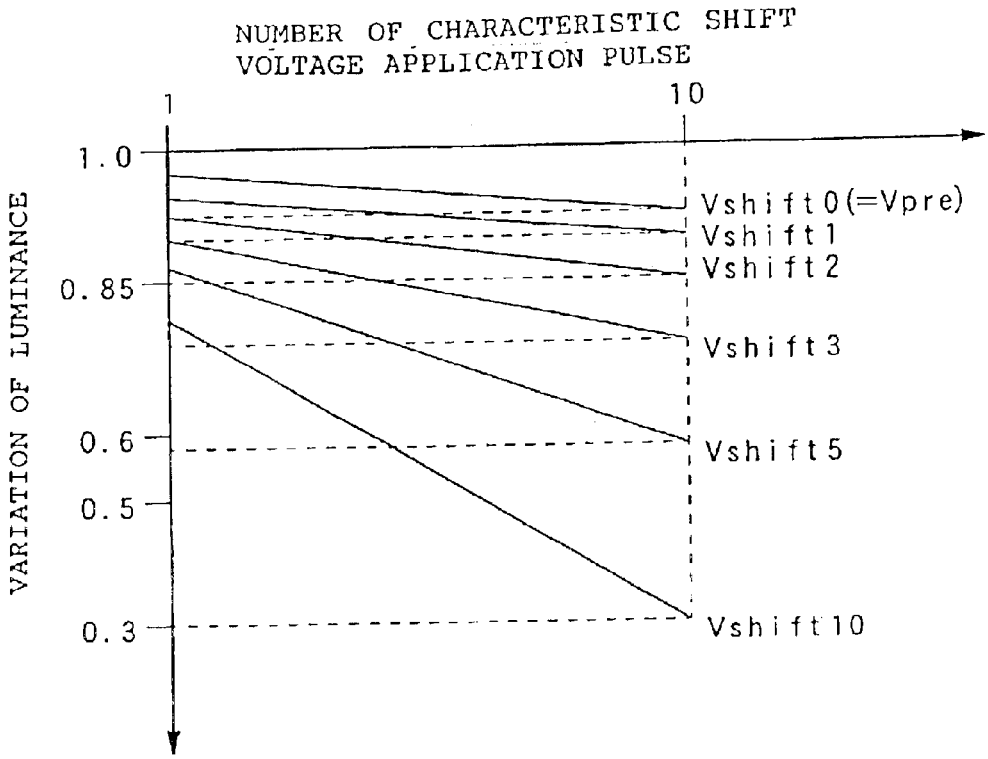
FIG. 18 shows characteristic curves illustrating variation of luminance with respect to each drive voltage when several kinds of the drive voltages were continuously applied.

FIG. 18 shows variation of the luminance (average value) after each of 11 kinds of the characteristic shift voltages Vshift0 (=Vpre), Vshift1, Vshift2, Vshift3, Vshift4 . . . Vshift10 was applied (10 pulses) to the plurality of the SCE-emitters.

The relation of 11 kinds of the characteristic shift voltages is of Vshift10> . . . Vshift4>Vshift3>Vshift2>Vshift1>Vpre.

As shown in FIG. 18, variation of the luminance is enlarged by enlarging the characteristic shift voltage. That is, adjustment amount is enlarged.

Since the second stage is the same as that of the first embodiment, description thereof will be omitted.

Here, similar to the embodiment 1, the luminance target value L0 is made to be of L0=(L-ave)−(σ-L).

Figure 19:
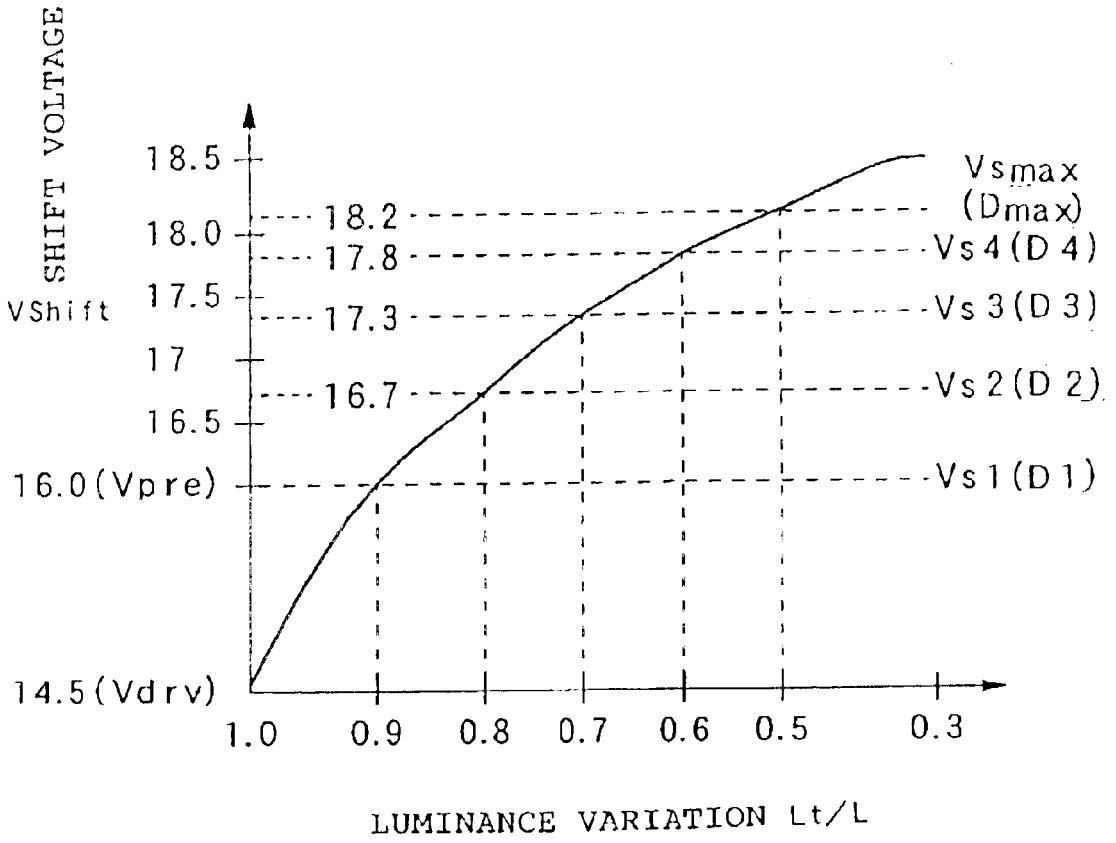
FIG. 19 is a view showing a range of the luminance corresponding to respective SCE-emitters to discrete shift voltage which is applied for adjusting the characteristic.

Next, from the characteristic variation curves shown in FIG. 18, the relation of the adjustment amount of the luminance and the characteristic shift voltage is plotted to prepare a graph as shown in FIG. 19, and used as the look-up table for adjustment. The adjustment is carried out by the following three steps.

Figure 16:
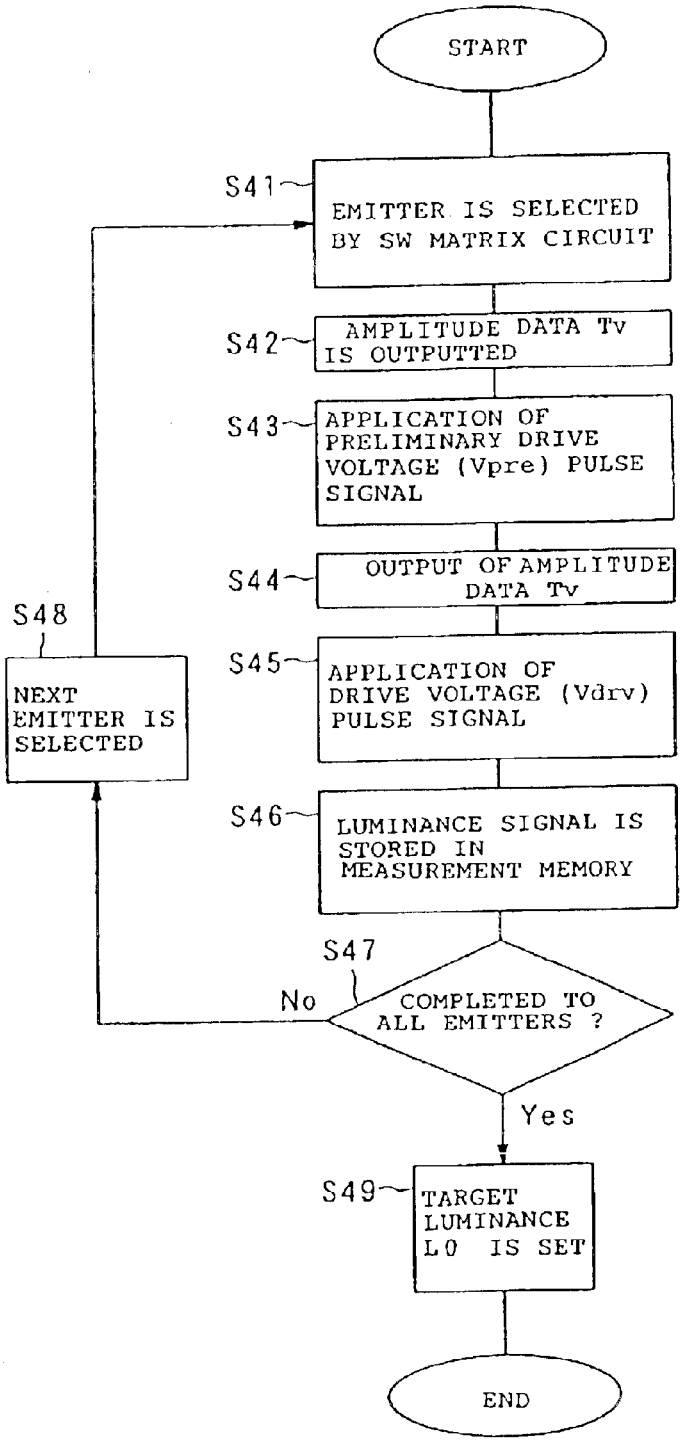
FIG. 16 is a characteristic adjustment flow chart of each SCE-emitter of the electron source.
Figure 17:
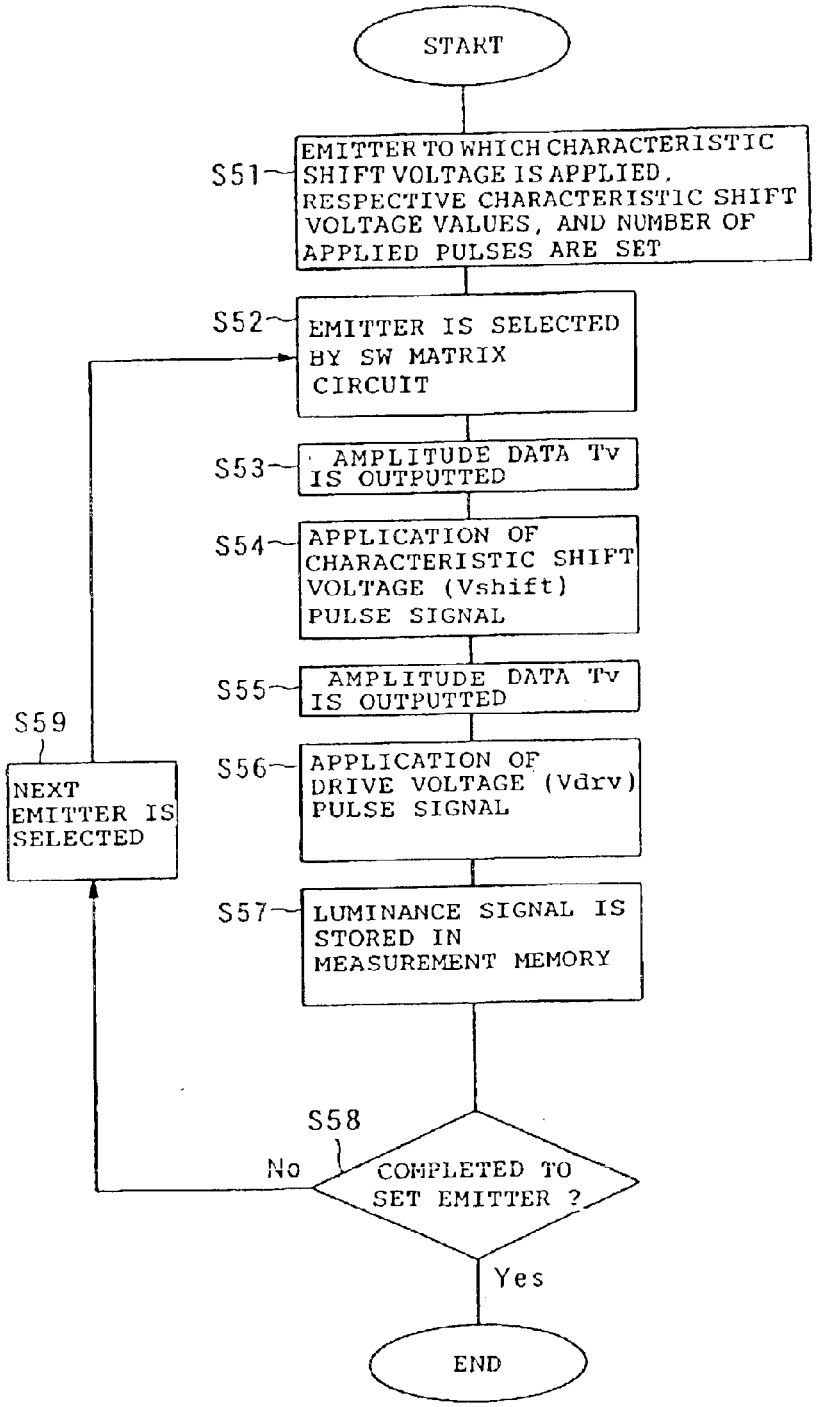
FIG. 17 is a characteristic adjustment flow chart following FIG. 16 of each SCE-emitter of the electron source.

(1) From the target luminance L0 and the maximum luminance Lmax which were set on the basis of the luminance measurement result of FIG. 16, the maximum adjustment rate Dmax=L0/Lmax is calculated, and by use of the adjustment look-up table of FIG. 19, desired maximum adjustment shift voltage is set.

(2) The number of the group of adjustment shift voltages=n is, by the acceptable luminance range ΔL from the luminance target value, calculated with a formula of n≧(Lmax−L0)/ΔL, and from the maximum adjustment rate, each adjustment rate Ds which is necessary for n equal divisions is calculated with Ds=1−((Dmax−1)m/n)[m=1 . . . n−1], and n pieces of the shift voltages necessary for each adjustment rate are selected.

(3) On the basis of the set values which were determined at (1) and (2), with respect to each emitter, application of the adjustment shift voltage and measurement of the luminance characteristic are repeated, and the characteristic is made to be shifted to the target value. That is, this is a stage (corresponds to a flow chart of FIG. 20 and the second and third periods of the characteristic adjustment period of FIG. 13A) in which, the adjustment shift voltage value is applied in response to the look-up table for characteristic adjustment and the luminance L is measured while the normal drive voltage Vdrv is applied in order to judge whether the characteristic adjustment was finished.

Further, the above process will be described in detail.

(1) The largest one of the luminance L which was measured in FIG. 16 is assumed to be Lmax value, and from the target L0 which was set in FIG. 16, the maximum adjustment rate Dmax is calculated from Dmax=L0/Lmax.

Assuming that the luminance target value L0=1, 0(arb.u.), and Lmax=2.0(arb.u.), required is Dmax=0.5. At this time, it is understood that, even if Vshift5 is applied as the maximum shift voltage from FIG. 18, all emitters can not be adjusted by 10 pulses. Then, in this embodiment, the maximum shift voltage is set from FIG. 19 so that the characteristic shift is carried out by the application of 10 pulses to each emitter.

As described above, in case that the maximum adjustment rate Dmax is 0.5, the maximum shift voltage can be set to 18.2V from FIG. 19.

With this setting, even the emitter with large adjustment width can be surely adjusted, and time which is required for this process can be estimated by product of time for applying 10 pulses and the number of emitters having equal to or more than the luminance target value L0.

(2) The number of the group of the adjustment shift voltages=n is, by the acceptable luminance range ΔL from the luminance target value, calculated with a formula of n≧(Lmax−L0)/ΔL, and from the maximum adjustment rate, each adjustment rate Ds which is necessary for n equal divisions is calculated with Ds=1−((Dmax−1)m/n)[m=1 . . . n−1], and n pieces of the shift voltages necessary for each adjustment rate are selected.

When ΔL is set to the acceptable value of 0.2, from (Lmax−L0)/ΔL, n becomes 5, and when the necessary maximum adjustment rate is of Dmax=0.5, hereinafter, the adjustment rate Ds becomes 5 steps in total of 0.6, 0.7, 0.8, and 0.9.

Respective adjustment shift voltages are, from FIG. 19, are determined as follows:

In case of Ds1=0.9, Vs1=16.0V,

In case of Ds2=0.8, Vs1=16.7V,

In case of Ds3=0.7, Vs1=17.3V,

In case of Ds4=0.6, Vs1=17.8V, and

In case of Dmax=0.5, Vsmax=18.2V.

In order to carry out the characteristic adjustment from upper limit of these respective light-emission luminance, the adjustment was carried out diving into 5 steps. Since the respective adjustment rates necessary for those are Ds1=0.9, Ds2=0.8, Ds3=0.7, Ds4=0.6, and Dmax=0.5, in case of the luminance signal maximum value=2.0(arb.u.), a range of the luminance L of the emitters to which respective adjustment shift voltages are applied becomes Lt<L1≦1.2(arb.u.) (@Vs_1), 1.2<L2≦1.4(arb.u.) (@Vs_2), 1.4<L3≦1.6 (arb.u.) (@Vs_3), 1.6<L4≦1.8(arb.u.) (@Vs_4), 1.8 (arb.u.)<Lmax(@Vs_max).

Next, an entire flow will be described by use of a flow chart of FIG. 20.

Firstly, at Step S61, set is the number of predetermined pulses which are applied at the time of characteristic adjustment to one of SCE-emitters to which the characteristic adjustment is carried out in the display panel 301. The number of the predetermined applied pulses is set to 10 pulses.

Next, at Step S62, the switch matrix control signal Tsw is outputted, and the switch matrixes 303 and 304 are switched by the switch matrix control circuit 310, and one of the SCE-emitters is selected from the display panel 301.

At Step S63, as to the selected emitter, the luminance L at the time of application of the normal drive voltage Vdrv after the preliminary drive is read out.

At Step S64, the characteristic adjustment look-up table is read out.

At Step S65, the luminance of the selected emitter which was read out at Step S63 is compared to the target value L0 in the characteristic adjustment, and it is judged whether or not the characteristic adjustment is carried out.

In case that the luminance L of the selected emitter which was read out at Step S63 is equal to or less than the target value L0 in the characteristic adjustment, the characteristic adjustment is not carried out and it goes on to Step S71.

In case that the luminance of the selected emitter which was read out at Step S63 is larger than the target value L0 in the characteristic adjustment, referring to the characteristic adjustment look-up table which was read out at Step S64, any one of the characteristic shift voltage values Vs1 to Vsmax corresponding to the luminance of the selected emitter is set.

And, at Step S66, the data Tv of the amplitude of the pulse signal which is applied to the selected emitter is outputted to the pulse amplitude setting circuit 311.

At Step S67, any one pulse signal of the characteristic shift values Vs1 to Vsmax was applied by 10 pulses to the SCE-emitter which was selected at Step S62, from the pulse generation circuits 306 and 307 through the switch matrixes 303 and 304.

At Step S68, in order to evaluate the luminance at the time when the emitter to which the characteristic adjustment was applied was driven by decreasing to the normal drive voltage Vdrv, as the data Tv of the amplitude of the pulse signal which is applied to the selected emitter, the normal drive voltage value Vdrv is set.

And, at Step S69, the pulse voltage of the normal drive voltage value Vdrv is applied to the SCE-emitter which was selected at Step S62. The Luminance at this time is measured and stored in the luminance storage memory 312*b* at Step 70.

At Step S71, it is investigated whether or not the characteristic adjustment was carried out to all of the SCE-emitters of the display panel 301, and if not, it goes on to Step S72 and a next SCE-emitter is selected, and the switch matrix control signal Tsw is outputted, and then, it goes on to Step S62.

At Step S72, when the procedure shown in the flow chart is finished for all of the emitters, the characteristic adjustment is completed, and the luminance of all emitters made uniform. Thus, the adjustment of the luminance characteristic is completed. The time which is required for this process at this time becomes product of the number of the emitter with approximately initial luminance being larger than the target value L0 and time for applying 10 pulses of the shift voltage.

The luminance variation of each pixel of the image forming apparatus which was adjusted in this manner is of the luminance L-σ/the luminance L-ave=2.5% and high quality images with small variation feeling can be displayed.

In addition, in this embodiment, the data of the luminance characteristic is obtained with by an image forming apparatus which was manufactured in the same manufacturing process as the image forming apparatus which is actually adjusted, and it is possible to use the same adjustment look-up table repeatedly, and it is possible to shorten the adjustment time.

Also, in the embodiments up to here, the adjustment method of the image forming apparatus with SCE-emitters was described. However, even in an image forming apparatus with FE-type and MIN-type emitters having memory functions, characteristic of the luminance of the individual pixels can be adjusted in the same manner.

As described above, in the invention, in an image forming apparatus having a multiple electron source in which a plurality of emitters are disposed, it becomes possible to make the characteristic of the each emitter uniform for approximately constant adjustment time of period. Accordingly, by realizing the uniformity of manufacturing process time of the image forming apparatus, it becomes easy to control the manufacturing process.

Also, it does not becomes long-duration processes, and it is possible to suppress the occurrence of emitters which are excessively deteriorated, and it is possible to improve the uniformity of images to be displayed, and it is also possible to suppress the decrease the luminance due to the characteristic adjustment.

Further, even if there is variation of the change rate of the emitter with respect to the characteristic shift voltage, by correcting the characteristic shift value voltage, it is possible to improve the uniformity.

What is claimed is:

1. A method for manufacturing an image forming apparatus having a multiple electron source in which a plurality of emitters are disposed on a substrate and fluorescent materials for emitting light by irradiation of electron beam from the multiple electron source, comprising:

a first measurement step of measuring change of luminance, when a pulse having a plurality of amplitude larger than drive voltage is applied to the predetermined number of the emitters, with respect to the amplitude of the pulse and the number of the pulse;

a step of preparing, on the basis of the measurement result of the first measurement step, a look-up table for storing the amplitude of the pulse and the number of the pulse for shifting characteristic of emitters to a predetermined luminance target value;

a second measurement step of measuring the luminance when the drive voltage is applied to the emitter; and a step of applying, on the basis of the measurement result of the second measurement step, characteristic shift voltage comprising a plurality of pulses in which the amplitude of the pulse obtained from the look-up table has two or more values, to the emitter.

2. A method for manufacturing the image forming apparatus according to claim 1, wherein the characteristic shift voltage comprises first pulses and second pulses, and after the first pulses are applied to the emitter, the second measurement step is carried out again, and the second pulses having the amplitude which was determined in response to the measurement result of the second measurement step is applied.

3. A method for manufacturing an image forming apparatus having a multiple electron source in which a plurality of emitters are disposed on a substrate and fluorescent materials for emitting light by irradiation of electron beam from the multiple electron source, comprising:

a first measurement step of measuring change of luminance, when a pulse having a plurality of amplitude larger than drive voltage is applied to the predetermined number of the emitters, to the amplitude of the pulse and the number of the pulse;

a step of preparing, on the basis of the measurement result of the first measurement step, a look-up table for storing the amplitude of the pulse and the number of the pulse for shifting characteristic of emitters to a predetermined luminance target value;

a second measurement step of measuring the luminance when the drive voltage is applied to the emitter; and a step of applying, on the basis of the measurement result of the second measurement step, characteristic shift voltage comprising a plurality of pulses in which pulse width of the pulse obtained from the look-up table has two or more values, to the emitter.

4. A method for manufacturing the image forming apparatus according to claim 3, wherein the characteristic shift voltage comprises first pulses and second pulses, and after the first pulses are applied to the emitter, the second measurement step is carried out again, and the second pulses having the amplitude which was determined in response to the measurement result of the second measurement step is applied.

5. A method for manufacturing an image forming apparatus having a multiple electron source in which a plurality of emitters are disposed on a substrate and fluorescent materials for emitting light by irradiation of electron beam from the multiple electron source, comprising:

a step of measuring change of luminance with respect to each of characteristic shift voltages and preparing a luminance adjustment rate table, when a plurality of characteristic shift voltages which have different voltage values larger than drive voltage are applied to the predetermined number of the emitters;

a step of measuring luminance to set luminance target value L0 and obtaining maximum luminance Lmax, when the drive voltage is applied to the emitter;

a step of determining maximum adjustment shift voltage and a group of the adjustment shift voltage with smaller voltage values than the maximum adjustment shift voltage, by referring to the luminance adjustment rate table with maximum adjustment rate Dmax of luminance of Dmax=L0/Lmax, and a step of applying the adjustment shift voltage selected from the adjustment shift voltage group to the emitter.

6. A method for manufacturing the image forming apparatus according to claim 5, wherein the group of the adjustment shift voltages comprises n pieces of adjustment shift voltages which satisfy a formula of $n \geqq (Lmax-L0)/\Delta L$ (provided, $\Delta L$ means variation acceptable scope of the luminance from the luminance target value L0), and the adjustment shift voltage is determined with reference to the luminance adjustment rate table from adjustment rate Ds satisfying a formula of $Ds=1-((Dmax)m/n)[m=1 \ldots n-1]$.

* * * * *

UNITED STATES PATENT AND TRADEMARK OFFICE

CERTIFICATE OF CORRECTION

PATENT NO. : 6,822,397 B2
DATED : November 23, 2004
INVENTOR(S) : Hideshi Kawasaki et al.

Figure 8:
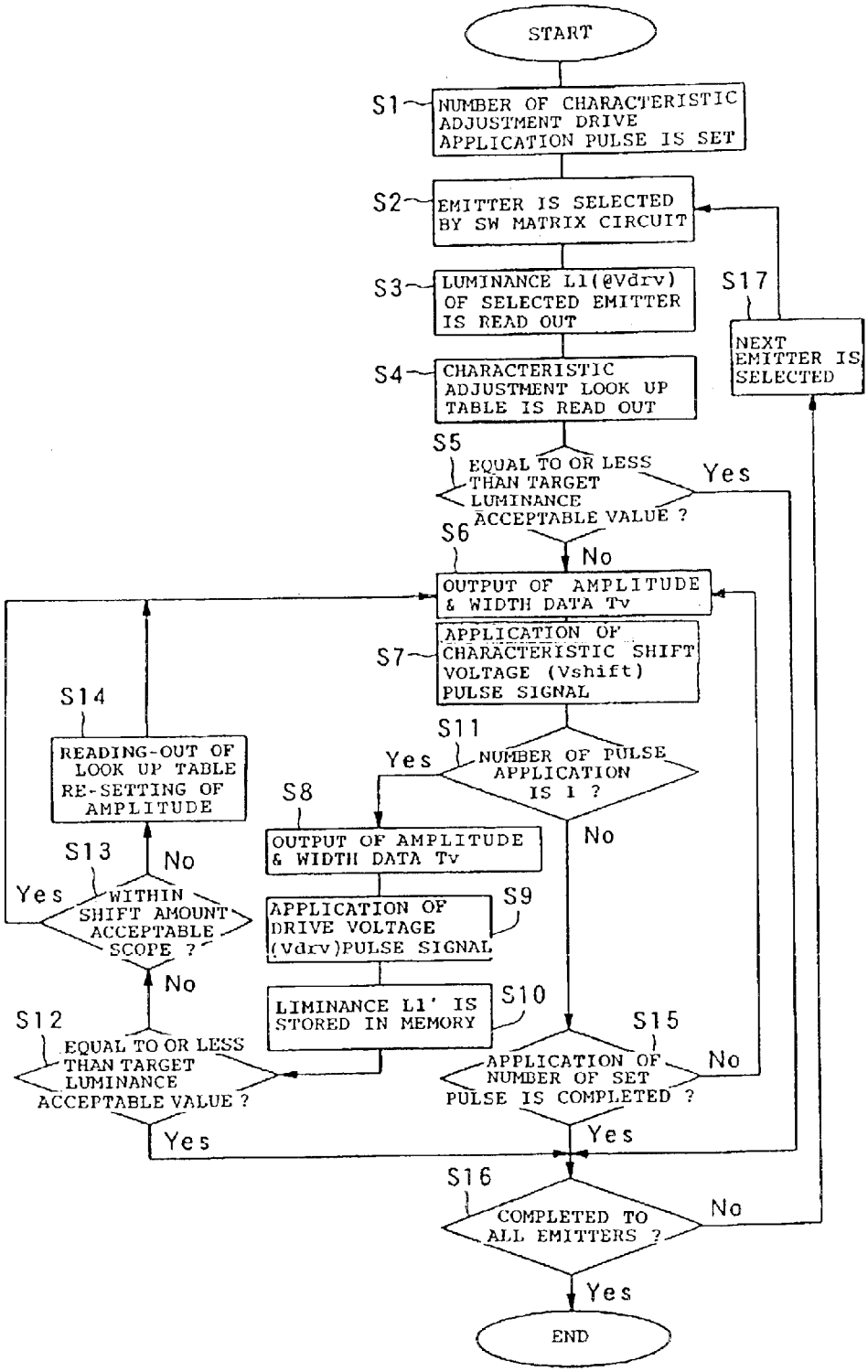
FIG. 8 is a characteristic adjustment flow chart of each SCE-emitter in the electron source of an example 2.
Figure 9:
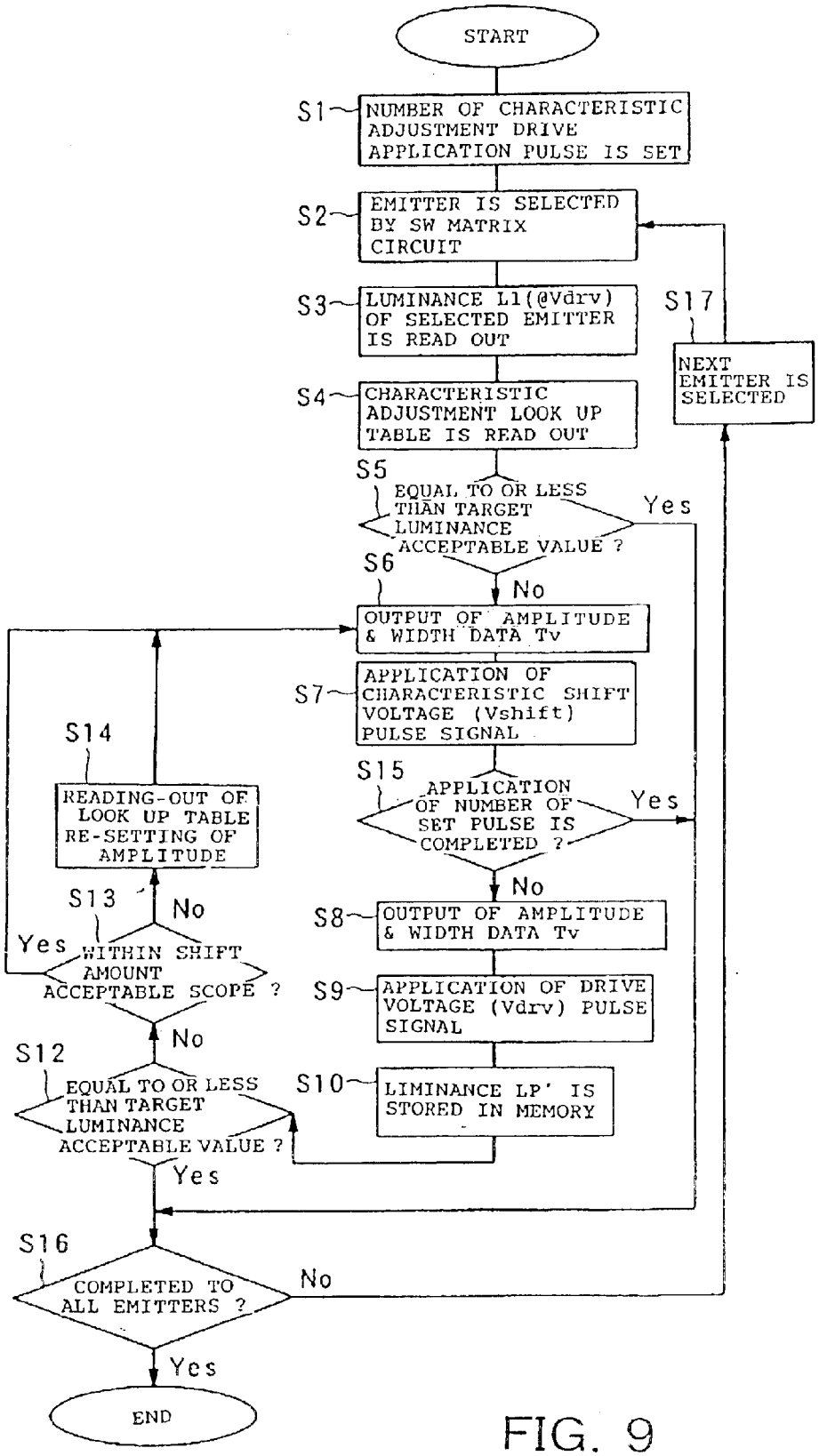
FIG. 9 is a characteristic adjustment flow chart of each SCE-emitter in the electron source of an example 3.

It is certified that error appears in the above-identified patent and that said Letters Patent is hereby corrected as shown below:

Drawings,
Sheet 8, Fig. 8, "LIMINANCE L1'" in step S10 should read -- LUMINANCE L1' --.
Sheet 9, Fig. 9, "LIMINANCE LP´" in step S10 should read -- LUMINANCE LP´ --.
Sheet 12, Fig. 12, "EEQUAL" in step S25 should read -- EQUAL -- and "EEEQUAL" in step S35 should read -- EQUAL --.

Column 1,
Line 54, "It" should read -- it --.
Line 66, "a" should read -- an --.

Column 2,
Line 9, "has" should read -- has as --.
Line 15, "SUMMERY" should read -- SUMMARY --.
Line 35, "the:" should read -- the --.

Column 3,
Line 56, "sift" should read -- shift --.

Column 5,
Line 30, "2-dimentional" should read -- 2-dimensional --.
Line 31, "An" should read -- A --.

Column 6,
Line 49, "Tysnc" should read -- Tsync --.

Column 10,
Line 48, "different two" should read -- two different --.

Column 11,
Line 28, "a" should read -- an --.
Line 32, "and" should read -- or --.

Column 14,
Line 26, "AS" should read -- As --.
Line 27, "soon," should read -- so on, --.

Column 16,
Line 5, "9600(a.u)." should read -- 9600 (a.u.). --
Line 27, "Vshift" should read -- Vshift. --.

UNITED STATES PATENT AND TRADEMARK OFFICE

CERTIFICATE OF CORRECTION

PATENT NO. : 6,822,397 B2
DATED : November 23, 2004
INVENTOR(S) : Hideshi Kawasaki et al.

It is certified that error appears in the above-identified patent and that said Letters Patent is hereby corrected as shown below:

Column 19,
Line 25, "Vshitf4" should read -- Vshift4 --.
Line 49, "Step S1" should read -- Step S10 --.

Column 20,
Line 11, "and-the" should read -- and the --.

Column 21,
Line 5, "of" should read -- of several --.
Line 6, "several" should be deleted.
Line 7, "regard to" should be deleted.
Line 8, "different two" should read -- two different --.
Line 46, "no" should read -- any --.
Line 57, "a" should read -- an --.
Line 61, "and" should read -- or --.

Column 23,
Line 49, "AS" should read -- As --.
Line 50, "soon," should read -- so on, --.

Column 24,
Line 50, "Vshit1 to Vshit4" should read -- Vshift 1 to Vshift 4 --.

Column 26,
Line 22, "Vshit1 to Vshit4" should read -- Vshift 1 to Vshift 4 --.

Column 27,
Line 55, "peirod," should read -- period, --.

UNITED STATES PATENT AND TRADEMARK OFFICE

CERTIFICATE OF CORRECTION

PATENT NO. : 6,822,397 B2
DATED : November 23, 2004
INVENTOR(S) : Hideshi Kawasaki et al.

It is certified that error appears in the above-identified patent and that said Letters Patent is hereby corrected as shown below:

Column 33,
Line 3, "Luminance" should read -- luminance --.
Line 5, "70." should read -- S70. --.
Line 26, "with" should be deleted.
Line 42, "of" should be deleted.
Line 46, "becomes long-duration processes," should read -- become a long duration process, --.
Line 50, "decrease" should read -- decrease in --.

Signed and Sealed this

Fourteenth Day of June, 2005

JON W. DUDAS
*Director of the United States Patent and Trademark Office*